US007427234B2

(12) United States Patent
Soltys et al.

(10) Patent No.: US 7,427,234 B2
(45) Date of Patent: Sep. 23, 2008

(54) METHOD, APPARATUS AND ARTICLE FOR HIERARCHICAL WAGERING

(75) Inventors: Richard Soltys, Newcastle, WA (US); Richard Huizinga, Newcastle, WA (US)

(73) Assignee: Bally Gaming, Inc., Las Vegas, NV (US)

( * ) Notice: Subject to any disclaimer, the term of this patent is extended or adjusted under 35 U.S.C. 154(b) by 143 days.

(21) Appl. No.: 11/337,375

(22) Filed: Jan. 23, 2006

(65) Prior Publication Data

US 2006/0121975 A1 Jun. 8, 2006

Related U.S. Application Data

(63) Continuation of application No. 10/061,636, filed on Feb. 1, 2002, now Pat. No. 6,991,544.

(60) Provisional application No. 60/300,253, filed on Jun. 21, 2001.

(51) Int. Cl.
*A63F 9/24* (2006.01)

(52) U.S. Cl. ..... 463/16; 463/25; 463/40; 463/42

(58) Field of Classification Search ..... 463/40, 463/42, 16, 25
See application file for complete search history.

(56) References Cited

U.S. PATENT DOCUMENTS

| | | | | |
|---|---|---|---|---|
| 4,031,376 | A | 6/1977 | Corkin, Jr. | 235/156 |
| 4,264,074 | A | 4/1981 | Sobajima | 273/149 R |
| 4,373,726 | A | 2/1983 | Churchill et al. | 273/138 A |
| 4,448,419 | A | 5/1984 | Telnaes | 273/143 R |
| 4,467,424 | A | 8/1984 | Hedges et al. | 364/412 |
| 4,662,637 | A | 5/1987 | Pfeiffer | 273/149 P |
| 4,693,480 | A | 9/1987 | Smith | 273/296 |
| 4,721,307 | A | 1/1988 | Okada | 273/143 R |
| 4,725,079 | A | 2/1988 | Koza et al. | 283/73 |
| 4,728,108 | A | 3/1988 | Neuwahl | 273/296 |
| 4,755,941 | A | 7/1988 | Bacchi | 364/412 |

(Continued)

FOREIGN PATENT DOCUMENTS

DE 199 40 954 A1 3/2001

(Continued)

OTHER PUBLICATIONS

U.S. Appl. No. 11/558,409, filed Nov. 9, 2006, Soltys.

(Continued)

*Primary Examiner*—Corbett B Coburn
(74) *Attorney, Agent, or Firm*—Seed IP Law Group PLLC

(57) ABSTRACT

A primary wager is placed by a primary player regarding an outcome of a gaming event, and a secondary wager is placed by a secondary player regarding an outcome of the primary wager. Tertiary wagers may also be placed regarding an outcome of the secondary wager. The outcome of the gaming event is determined. The outcome of the primary wager is determined based on the determined outcome of the gaming event. The outcome of the secondary wager is determined based on the determined outcome of the primary wager. The outcome of the tertiary wager is determined based on the outcome of the secondary wager. Winnings and losses are paid and collected, respectively. Wagering can be local or remote. Statistics and/or odds can be generated and displayed.

15 Claims, 10 Drawing Sheets

U.S. PATENT DOCUMENTS

| | | | | |
|---|---|---|---|---|
| 4,832,341 | A | 5/1989 | Muller et al. | 273/139 |
| 4,837,728 | A | 6/1989 | Barrie et al. | 364/412 |
| 4,861,041 | A | 8/1989 | Jones et al. | 273/292 |
| 4,885,700 | A | 12/1989 | Kondziolka et al. | 364/519 |
| 4,995,615 | A | 2/1991 | Cheng | 273/292 |
| 4,998,737 | A | 3/1991 | Lamle | 273/296 |
| 5,007,641 | A | 4/1991 | Seidman | 273/138 A |
| 5,031,914 | A | 7/1991 | Rosenthal | 273/146 |
| 5,042,809 | A | 8/1991 | Richardson | 273/138 |
| 5,067,713 | A | 11/1991 | Soules et al. | 273/149 P |
| 5,083,800 | A | 1/1992 | Lockton | 273/439 |
| 5,100,137 | A | 3/1992 | Fulton | 273/85 CP |
| 5,154,419 | A | 10/1992 | Madhavan | 273/126 R |
| 5,157,602 | A | 10/1992 | Fields et al. | 364/412 |
| 5,167,413 | A | 12/1992 | Fulton | 273/85 CP |
| 5,179,517 | A | 1/1993 | Sarbin et al. | 364/410 |
| 5,184,821 | A | 2/1993 | Korenek | 273/138 A |
| 5,188,363 | A | 2/1993 | Marnell, II et al. | 273/85 CP |
| 5,199,710 | A | 4/1993 | Lamle | 273/149 R |
| 5,242,163 | A | 9/1993 | Fulton | 273/85 CP |
| 5,248,142 | A | 9/1993 | Breeding | 273/138 R |
| 5,251,897 | A | 10/1993 | Fulton | 273/85 CP |
| 5,288,081 | A | 2/1994 | Breeding | 273/292 |
| 5,322,295 | A | 6/1994 | Cabot et al. | 273/292 |
| 5,324,035 | A | 6/1994 | Morris et al. | 273/138 A |
| 5,326,104 | A | 7/1994 | Pease et al. | 273/138 A |
| 5,344,144 | A | 9/1994 | Canon | 273/138 A |
| 5,361,885 | A | 11/1994 | Modler | 194/214 |
| 5,364,104 | A | 11/1994 | Jones et al. | 273/292 |
| 5,393,057 | A | 2/1995 | Marnell, II | 273/85 CP |
| 5,393,067 | A | 2/1995 | Paulsen et al. | 273/292 |
| 5,397,133 | A | 3/1995 | Penzias | 273/439 |
| 5,398,932 | A | 3/1995 | Eberhardt et al. | 273/138 A |
| 5,411,257 | A | 5/1995 | Fulton | 273/85 CP |
| 5,417,430 | A | 5/1995 | Breeding | 273/292 |
| 5,431,408 | A | 7/1995 | Adams | 273/306 |
| 5,437,451 | A | 8/1995 | Fulton | 273/138 A |
| 5,437,462 | A | 8/1995 | Breeding | 273/292 |
| 5,466,010 | A | 11/1995 | Spooner | 283/67 |
| 5,472,194 | A | 12/1995 | Breeding et al. | 273/138 A |
| 5,487,544 | A | 1/1996 | Clapper, Jr. | 273/138 A |
| 5,505,449 | A | 4/1996 | Eberhardt et al. | 273/138 A |
| 5,505,461 | A | 4/1996 | Bell et al. | 273/433 |
| 5,511,784 | A | 4/1996 | Furry et al. | 273/143 R |
| 5,544,892 | A | 8/1996 | Breeding | 273/292 |
| 5,544,893 | A | 8/1996 | Jones et al. | 273/309 |
| 5,562,284 | A | 10/1996 | Stevens | 273/139 |
| 5,564,700 | A | 10/1996 | Celona | 463/27 |
| 5,570,885 | A | 11/1996 | Ornstein | 463/27 |
| 5,575,474 | A | 11/1996 | Rossides | 463/26 |
| 5,586,936 | A | 12/1996 | Bennett et al. | 463/25 |
| 5,595,538 | A | 1/1997 | Haste, III | 463/17 |
| 5,605,334 | A | 2/1997 | McCrea, Jr. | 273/309 |
| 5,613,912 | A | 3/1997 | Slater | 463/25 |
| 5,632,489 | A | 5/1997 | Rozzi, Sr. et al. | 273/304 |
| 5,643,088 | A | 7/1997 | Vaughn et al. | 463/40 |
| 5,645,486 | A | 7/1997 | Nagao et al. | 463/27 |
| 5,647,592 | A | 7/1997 | Gerow | 273/139 |
| 5,651,548 | A | 7/1997 | French et al. | 273/309 |
| 5,653,635 | A | 8/1997 | Breeding | 463/11 |
| 5,655,961 | A | 8/1997 | Acres et al. | 463/27 |
| 5,669,816 | A | 9/1997 | Garczynski et al. | 463/12 |
| 5,679,077 | A | 10/1997 | Pocock et al. | 463/19 |
| 5,685,774 | A | 11/1997 | Webb | 463/13 |
| 5,698,839 | A | 12/1997 | Jagielinski et al. | 235/493 |
| 5,707,287 | A | 1/1998 | McCrea, Jr. | 463/27 |
| 5,711,525 | A | 1/1998 | Breeding | 273/292 |
| 5,720,484 | A | 2/1998 | Hsu | 273/292 |
| 5,732,948 | A | 3/1998 | Yoseloff | 273/274 |
| 5,735,525 | A | 4/1998 | McCrea, Jr. | 273/309 |
| 5,735,742 | A | 4/1998 | French | 463/25 |
| 5,741,183 | A | 4/1998 | Acres et al. | 463/42 |
| 5,743,526 | A | 4/1998 | Inoue | 273/144 R |
| 5,759,102 | A | 6/1998 | Pease et al. | 463/42 |
| 5,766,074 | A | 6/1998 | Cannon et al. | 463/16 |
| 5,766,075 | A | 6/1998 | Cook et al. | 463/25 |
| 5,766,076 | A | 6/1998 | Pease et al. | 463/27 |
| 5,769,458 | A | 6/1998 | Carides et al. | 283/102 |
| 5,769,716 | A | 6/1998 | Saffari et al. | 463/20 |
| 5,770,533 | A | 6/1998 | Franchi | 463/42 |
| 5,779,545 | A | 7/1998 | Berg et al. | 463/22 |
| 5,788,573 | A | 8/1998 | Baerlocher et al. | 463/16 |
| 5,788,574 | A | 8/1998 | Ornstein et al. | 463/25 |
| 5,791,988 | A | 8/1998 | Nomi | 463/11 |
| 5,794,964 | A | 8/1998 | Jones et al. | 273/309 |
| 5,795,225 | A | 8/1998 | Jones et al. | 463/13 |
| 5,803,808 | A | 9/1998 | Strisower | 463/11 |
| 5,803,809 | A | 9/1998 | Yoseloff | 463/13 |
| 5,813,912 | A | 9/1998 | Shultz | 463/25 |
| 5,820,460 | A | 10/1998 | Fulton | 463/13 |
| 5,820,463 | A | 10/1998 | O'Callaghan | 463/42 |
| 5,823,879 | A | 10/1998 | Goldberg et al. | 463/42 |
| 5,830,064 | A | 11/1998 | Bradish et al. | 463/22 |
| 5,831,669 | A | 11/1998 | Adrain | 348/143 |
| 5,836,586 | A | 11/1998 | Marks et al. | 273/292 |
| 5,839,730 | A | 11/1998 | Pike | 273/292 |
| 5,842,921 | A | 12/1998 | Mindes et al. | 463/16 |
| 5,851,011 | A | 12/1998 | Lott | 273/292 |
| 5,851,148 | A | 12/1998 | Brune et al. | 463/25 |
| 5,855,515 | A | 1/1999 | Pease et al. | 463/27 |
| 5,863,249 | A | 1/1999 | Inoue | 463/20 |
| 5,871,400 | A | 2/1999 | Yfantis | 463/22 |
| 5,885,158 | A | 3/1999 | Torango et al. | 463/27 |
| 5,890,963 | A | 4/1999 | Yen | 463/42 |
| 5,911,418 | A | 6/1999 | Adams | 273/274 |
| 5,911,419 | A | 6/1999 | Delaney et al. | 273/292 |
| 5,911,626 | A | 6/1999 | McCrea, Jr. | 463/27 |
| 5,919,088 | A | 7/1999 | Weiss | 463/9 |
| 5,919,090 | A | 7/1999 | Mothwurf | 463/25 |
| 5,919,091 | A | 7/1999 | Bell et al. | 463/25 |
| 5,934,999 | A | 8/1999 | Valdez | 463/17 |
| 5,947,821 | A | 9/1999 | Stone | 463/13 |
| 5,967,893 | A | 10/1999 | Lawrence et al. | 463/10 |
| 5,980,384 | A | 11/1999 | Barrie | 463/16 |
| 5,980,385 | A | 11/1999 | Clapper, Jr. | 463/17 |
| 5,989,122 | A | 11/1999 | Roblejo | 463/22 |
| 6,001,016 | A | 12/1999 | Walker et al. | 463/42 |
| 6,003,013 | A | 12/1999 | Boushy et al. | 705/10 |
| 6,004,205 | A | 12/1999 | Lauretta et al. | 463/11 |
| 6,010,404 | A | 1/2000 | Walker et al. | 463/21 |
| 6,019,374 | A | 2/2000 | Breeding | 273/292 |
| 6,032,955 | A | 3/2000 | Luciano et al. | 273/138.1 |
| 6,039,649 | A | 3/2000 | Schulze | 463/16 |
| 6,039,650 | A | 3/2000 | Hill | 463/47 |
| 6,045,130 | A | 4/2000 | Jones et al. | 273/292 |
| 6,050,895 | A | 4/2000 | Luciano, Jr. et al. | 463/7 |
| 6,056,641 | A | 5/2000 | Webb | 463/13 |
| 6,059,289 | A | 5/2000 | Vancura | 273/143 R |
| 6,059,658 | A | 5/2000 | Mangano et al. | 463/16 |
| 6,062,979 | A | 5/2000 | Inoue | 463/12 |
| 6,062,981 | A | 5/2000 | Luciano, Jr. | 463/26 |
| 6,068,262 | A | 5/2000 | Goldfarb et al. | 273/457 |
| 6,068,552 | A | 5/2000 | Walker et al. | 463/21 |
| 6,068,553 | A | 5/2000 | Parker | 463/27 |
| 6,070,878 | A | 6/2000 | Jones et al. | 273/309 |
| 6,077,161 | A | 6/2000 | Wisler | 463/11 |
| 6,080,063 | A | 6/2000 | Khosla | 463/42 |
| 6,086,477 | A | 7/2000 | Walker et al. | 463/17 |
| 6,089,978 | A | 7/2000 | Adams | 463/20 |
| 6,089,980 | A | 7/2000 | Gauselmann | 463/27 |
| 6,093,103 | A | 7/2000 | McCrea, Jr. | 463/27 |
| 6,099,407 | A | 8/2000 | Parker, Jr. et al. | 463/19 |
| 6,102,799 | A | 8/2000 | Stupak | 463/27 |
| 6,104,815 | A | 8/2000 | Alcorn et al. | 380/251 |

6,106,395 A 8/2000 Begis ..... 463/23
6,110,041 A 8/2000 Walker et al. ..... 463/20
6,110,043 A 8/2000 Olsen ..... 463/27
6,113,493 A 9/2000 Walker et al. ..... 463/25
6,117,009 A 9/2000 Yoseloff ..... 463/20
6,117,012 A 9/2000 McCrea, Jr. ..... 463/27
6,120,377 A 9/2000 McGinnis, Sr. et al. ..... 463/20
6,123,333 A 9/2000 McGinnis, Sr. et al. ..... 273/146
6,126,542 A 10/2000 Fier ..... 463/16
6,135,887 A 10/2000 Pease et al. ..... 463/42
6,142,876 A 11/2000 Cumbers ..... 463/25
6,145,835 A 11/2000 Such ..... 273/139
6,146,273 A 11/2000 Olsen ..... 463/27
6,149,154 A 11/2000 Grauzer et al. ..... 273/149 R
6,149,155 A 11/2000 Hoyt et al. ..... 273/292
6,152,822 A 11/2000 Herbert ..... 463/22
6,152,824 A 11/2000 Rothschild et al. ..... 463/42
6,154,131 A 11/2000 Jones, II et al. ..... 340/540
6,159,096 A 12/2000 Yoseloff ..... 463/20
6,165,069 A 12/2000 Sines et al. ..... 463/12
6,165,070 A 12/2000 Nolte et al. ..... 463/20
6,165,071 A 12/2000 Weiss ..... 463/24
6,168,523 B1 1/2001 Piechowiak et al. ..... 463/26
6,179,711 B1 1/2001 Yoseloff ..... 463/25
6,183,361 B1 2/2001 Cummings et al. ..... 463/18
6,183,362 B1 2/2001 Boushy ..... 463/25
6,183,366 B1 2/2001 Goldberg et al. ..... 463/42
6,186,892 B1 2/2001 Frank et al. ..... 463/19
6,186,894 B1 2/2001 Mayeroff ..... 463/20
6,186,895 B1 2/2001 Oliver ..... 463/25
6,193,607 B1 2/2001 Kay ..... 463/22
6,196,547 B1 3/2001 Pascal et al. ..... 273/292
6,203,427 B1 3/2001 Walker et al. ..... 463/16
6,203,430 B1 3/2001 Walker et al. ..... 463/20
6,210,275 B1 4/2001 Olsen ..... 463/16
6,210,277 B1 4/2001 Stefan ..... 463/27
6,213,877 B1 4/2001 Walker et al. ..... 463/26
6,220,960 B1 4/2001 Kryzhanovsky ..... 463/13
6,224,483 B1 5/2001 Mayeroff ..... 463/20
6,224,484 B1 5/2001 Okuda et al. ..... 463/27
6,227,969 B1 5/2001 Yoseloff ..... 463/13
6,234,898 B1 5/2001 Belamant et al. ..... 463/25
6,237,916 B1 5/2001 Webb ..... 273/292
6,244,958 B1 6/2001 Acres ..... 463/26
6,254,484 B1 7/2001 McCrea, Jr. ..... 463/27
6,267,671 B1 7/2001 Hogan ..... 463/25
6,273,424 B1 8/2001 Breeding ..... 273/292
6,286,834 B1 9/2001 Caputo ..... 273/274
6,287,202 B1 9/2001 Pascal et al. ..... 463/42
6,290,603 B1 9/2001 Luciano, Jr. ..... 463/25
6,293,864 B1 9/2001 Romero ..... 463/12
6,299,536 B1 10/2001 Hill ..... 463/47
6,309,300 B1 10/2001 Glavich ..... 463/26
6,312,334 B1 11/2001 Yoseloff ..... 463/25
6,315,664 B1 11/2001 Baerlocher et al. ..... 463/21
6,322,078 B1 11/2001 Adams ..... 273/292
6,328,649 B1 12/2001 Randall et al. ..... 463/20
6,331,143 B1 12/2001 Yoseloff ..... 463/18
6,334,613 B1 1/2002 Yoseloff ..... 273/292
6,334,614 B1 1/2002 Breeding ..... 273/292
6,334,814 B1 1/2002 Adams ..... 463/20
6,336,858 B1 1/2002 Yoseloff ..... 463/13
6,336,863 B1 1/2002 Baerlocher et al. ..... 463/27
6,345,823 B1 2/2002 Webb ..... 273/292
6,346,043 B1 2/2002 Colin et al. ..... 463/17
6,346,044 B1 2/2002 McCrea, Jr. ..... 463/27
6,350,199 B1 2/2002 Williams et al. ..... 463/16
6,364,767 B1 4/2002 Brossard et al. ..... 463/20
6,371,482 B1 4/2002 Hall, Jr. ..... 273/138.1
6,375,187 B1 4/2002 Baerlocher ..... 273/143 R
6,386,973 B1 5/2002 Yoseloff ..... 463/13
6,394,902 B1 5/2002 Glavich ..... 463/20
6,406,023 B1 6/2002 Rowe ..... 273/292
6,406,369 B1 6/2002 Baerlocher et al. ..... 463/20
6,409,595 B1 6/2002 Uihlein et al. ..... 463/29
6,409,602 B1 6/2002 Wiltshire et al. ..... 463/42
6,413,161 B1 7/2002 Baerlocher et al. ..... 463/20
6,413,162 B1 7/2002 Baerlocher et al. ..... 463/20
6,416,408 B2 7/2002 Tracy et al. ..... 463/16
6,419,583 B1 7/2002 Crumby et al. ..... 463/42
6,425,824 B1 7/2002 Baerlocher et al. ..... 463/16
6,435,970 B1 8/2002 Baerlocher et al. ..... 463/46
6,439,995 B1 8/2002 Hughs-Baird et al. ..... 463/20
6,443,452 B1 9/2002 Brune ..... 273/143 R
6,446,864 B1 9/2002 Kim et al. ..... 235/382
6,454,266 B1 9/2002 Breeding et al. ..... 273/292
6,454,651 B1 9/2002 Yoseloff ..... 463/25
6,457,715 B1 10/2002 Friedman ..... 273/274
6,460,848 B1 10/2002 Soltys et al. ..... 273/149 R
6,461,241 B1 10/2002 Webb et al. ..... 463/20
6,464,581 B1 10/2002 Yoseloff ..... 463/20
6,464,582 B1 10/2002 Baerlocher et al. ..... 463/20
6,464,584 B2 10/2002 Oliver ..... 463/25
6,468,156 B1 10/2002 Hughs-Baird et al. ..... 463/25
6,471,208 B2 10/2002 Yoseloff et al. ..... 273/143 R
6,471,591 B1 10/2002 Crumby ..... 463/26
6,485,366 B1 11/2002 Rowe ..... 463/13
6,494,454 B2 12/2002 Adams ..... 273/292
6,494,785 B1 12/2002 Gerrard et al. ..... 463/20
6,497,408 B1 12/2002 Walker et al. ..... 273/138.1
6,506,118 B1 1/2003 Baerlocher et al. ..... 463/25
6,508,709 B1 1/2003 Karmarkar ..... 463/42
6,508,710 B1 1/2003 Paravia et al. ..... 463/42
6,511,375 B1 1/2003 Kaminkow ..... 463/20
6,514,140 B1 2/2003 Storch ..... 463/25
6,514,141 B1 2/2003 Kaminkow et al. ..... 463/25
6,517,435 B2 2/2003 Soltys et al. ..... 463/25
6,517,436 B2 2/2003 Soltys et al. ..... 463/29
6,517,437 B1 2/2003 Wells et al. ..... 463/30
6,520,857 B2 2/2003 Soltys et al. ..... 463/29
6,527,271 B2 3/2003 Soltys et al. ..... 273/148 R
6,530,836 B2 3/2003 Soltys et al. ..... 463/29
6,530,837 B2 3/2003 Soltys et al. ..... 463/29
6,533,276 B2 3/2003 Soltys et al. ..... 273/148 R
6,533,662 B2 3/2003 Soltys et al. ..... 463/25
6,533,664 B1 3/2003 Crumby ..... 463/42
6,561,900 B1 5/2003 Baerlocher et al. ..... 463/20
6,565,433 B1 5/2003 Baerlocher et al. ..... 463/20
6,565,436 B1 5/2003 Baerlocher ..... 463/26
6,569,015 B1 5/2003 Baerlocher et al. ..... 463/16
6,572,472 B1 6/2003 Glavich ..... 463/16
6,572,473 B1 6/2003 Baerlocher ..... 463/20
6,575,829 B2 6/2003 Coleman et al. ..... 463/20
6,575,834 B1 6/2003 Lindo ..... 463/40
6,579,180 B2 6/2003 Soltys et al. ..... 463/25
6,579,181 B2 6/2003 Soltys et al. ..... 463/25
6,582,301 B2 6/2003 Hill ..... 463/11
6,582,306 B1 6/2003 Kaminkow ..... 463/20
6,582,307 B2 6/2003 Webb ..... 463/22
6,585,588 B2 7/2003 Hartl ..... 463/16
6,585,591 B1 7/2003 Baerlocher et al. ..... 463/25
6,585,592 B1 7/2003 Crumby ..... 463/26
6,592,458 B1 7/2003 Ho ..... 463/17
6,595,854 B2 7/2003 Hughs-Baird et al. ..... 463/20
6,595,857 B2 7/2003 Soltys et al. ..... 463/29
6,599,185 B1 7/2003 Kaminkow et al. ..... 463/16
6,599,192 B1 7/2003 Baerlocher et al. ..... 463/25
6,599,193 B2 7/2003 Baerlocher et al. ..... 463/27
6,602,135 B1 8/2003 Gerrard ..... 463/16
6,602,136 B1 8/2003 Baerlocher et al. ..... 463/16
6,602,137 B2 8/2003 Kaminkow et al. ..... 463/16
6,604,741 B1 8/2003 Snow ..... 273/292
6,605,000 B2 8/2003 Adams ..... 463/20
6,607,438 B2 8/2003 Baerlocher et al. ..... 463/16
6,609,974 B2 8/2003 Mead et al. ..... 463/25
6,620,046 B2 9/2003 Rowe ..... 463/25

| | | | | |
|---|---|---|---|---|
| 6,628,939 | B2 | 9/2003 | Paulsen | 455/414 |
| 6,629,889 | B2 | 10/2003 | Mothwurf | 463/25 |
| 6,632,139 | B1 | 10/2003 | Baerlocher | 463/16 |
| 6,634,943 | B1 | 10/2003 | Baerlocher | 463/25 |
| 6,634,945 | B2 | 10/2003 | Glavich et al. | 463/25 |
| 6,638,161 | B2 | 10/2003 | Soltys et al. | 463/12 |
| 6,638,164 | B2 | 10/2003 | Randall et al. | 463/20 |
| 6,641,484 | B2 | 11/2003 | Oles et al. | 463/47 |
| 6,645,073 | B2 | 11/2003 | Lemay et al. | 463/20 |
| 6,645,078 | B1 | 11/2003 | Mattice | 463/42 |
| 6,648,753 | B1 | 11/2003 | Tracy et al. | 463/16 |
| 6,648,754 | B2 | 11/2003 | Baerlocher et al. | 463/17 |
| 6,651,985 | B2 | 11/2003 | Sines et al. | 273/309 |
| 6,655,684 | B2 | 12/2003 | Grauzer et al. | 273/149 R |
| 6,659,461 | B2 | 12/2003 | Yoseloff et al. | 273/274 |
| 6,659,864 | B2 | 12/2003 | McGahn et al. | 463/16 |
| 6,663,488 | B1 | 12/2003 | Adams | 463/17 |
| 6,663,489 | B2 | 12/2003 | Baerlocher | 463/20 |
| 6,663,490 | B2 | 12/2003 | Soltys et al. | 463/25 |
| 6,666,766 | B2 | 12/2003 | Baerlocher et al. | 463/16 |
| 6,669,559 | B1 | 12/2003 | Baerlocher et al. | 463/16 |
| 6,672,589 | B1 | 1/2004 | Lemke et al. | 273/236 |
| 6,676,516 | B2 | 1/2004 | Baerlocher et al. | 463/25 |
| 6,676,522 | B2 | 1/2004 | Rowe et al. | 463/42 |
| 6,682,419 | B2 | 1/2004 | Webb et al. | 463/16 |
| 6,682,420 | B2 | 1/2004 | Webb et al. | 463/16 |
| 6,682,421 | B1 | 1/2004 | Rowe et al. | 463/25 |
| 6,682,423 | B2 | 1/2004 | Brosnan et al. | 463/29 |
| 6,685,564 | B2 | 2/2004 | Oliver | 463/25 |
| 6,685,568 | B2 | 2/2004 | Soltys et al. | 463/47 |
| 6,688,975 | B2 | 2/2004 | Baerlocher et al. | 463/16 |
| 6,688,977 | B1 | 2/2004 | Baerlocher et al. | 463/25 |
| 6,688,979 | B2 | 2/2004 | Soltys et al. | 463/25 |
| 6,692,354 | B2 | 2/2004 | Tracy et al. | 463/16 |
| 6,692,355 | B2 | 2/2004 | Baerlocher et al. | 463/16 |
| 6,695,695 | B2 | 2/2004 | Angel | 463/13 |
| 6,698,759 | B2 | 3/2004 | Webb et al. | 273/292 |
| 6,702,672 | B1 | 3/2004 | Angell et al. | 463/25 |
| 6,712,693 | B1 | 3/2004 | Hettinger | 463/20 |
| 6,712,696 | B2 | 3/2004 | Soltys et al. | 463/25 |
| 6,712,698 | B2 | 3/2004 | Paulsen et al. | 463/30 |
| 6,719,632 | B2 | 4/2004 | Palmer et al. | 463/25 |
| 6,722,974 | B2 | 4/2004 | Sines et al. | 463/12 |
| 6,722,981 | B2 | 4/2004 | Kaminkow et al. | 463/25 |
| 6,722,982 | B2 | 4/2004 | Kaminkow et al. | 463/25 |
| 6,722,983 | B2 | 4/2004 | Kaminkow et al. | 463/26 |
| 6,722,985 | B2 | 4/2004 | Criss-Puszkiewicz et al. | 463/29 |
| 6,726,427 | B2 | 4/2004 | Jarvis et al. | 413/12 |
| 6,726,563 | B1 | 4/2004 | Baerlocher et al. | 463/25 |
| 6,726,565 | B2 | 4/2004 | Hughs-Baird | 463/25 |
| 6,728,740 | B2 | 4/2004 | Kelly et al. | 708/250 |
| 6,729,956 | B2 | 5/2004 | Wolf et al. | 463/25 |
| 6,729,961 | B1 | 5/2004 | Millerschone | 463/30 |
| 6,733,386 | B2 | 5/2004 | Cuddy et al. | 463/17 |
| 6,733,389 | B2 | 5/2004 | Webb et al. | 463/20 |
| 6,739,973 | B1 | 5/2004 | Lucchesi et al. | 463/35 |
| 6,749,502 | B2 | 6/2004 | Baerlocher | 463/16 |
| 6,749,504 | B2 | 6/2004 | Hughs-Baird | 463/25 |
| 6,755,741 | B1 | 6/2004 | Rafaeli | 463/25 |
| 6,758,747 | B2 | 7/2004 | Baerlocher | 463/16 |
| 6,758,750 | B2 | 7/2004 | Baerlocher et al. | 463/25 |
| 6,758,751 | B2 | 7/2004 | Soltys et al. | 463/29 |
| 6,761,632 | B2 | 7/2004 | Bansemer et al. | 463/16 |
| 6,769,982 | B1 | 8/2004 | Brosnan | 463/16 |
| 6,769,983 | B2 | 8/2004 | Slomiany | 463/16 |
| 6,789,801 | B2 | 9/2004 | Snow | 273/292 |
| 6,808,173 | B2 | 10/2004 | Snow | 273/292 |
| 6,811,488 | B2 | 11/2004 | Paravia et al. | 463/42 |
| 6,846,238 | B2 | 1/2005 | Wells | 463/39 |
| 6,848,994 | B1 | 2/2005 | Knust et al. | 463/25 |
| 6,857,961 | B2 | 2/2005 | Soltys et al. | 463/47 |
| 6,874,786 | B2 | 4/2005 | Bruno et al. | 273/306 |
| 6,896,618 | B2 | 5/2005 | Benoy et al. | 463/25 |
| 6,923,446 | B2 | 8/2005 | Snow | 273/292 |
| 6,938,900 | B2 | 9/2005 | Snow | 273/292 |
| 6,955,599 | B2 | 10/2005 | Bourbour et al. | 463/13 |
| 6,960,134 | B2 | 11/2005 | Hartl et al. | 463/20 |
| 6,964,612 | B2 | 11/2005 | Soltys et al. | 463/47 |
| 6,969,319 | B2 | 11/2005 | Rowe et al. | 463/25 |
| 6,986,514 | B2 | 1/2006 | Snow | 273/292 |
| 6,991,544 | B2 | 1/2006 | Soltys et al. | 463/42 |
| 7,029,009 | B2 | 4/2006 | Grauzer et al. | 273/149 P |
| 7,073,791 | B2 | 7/2006 | Grauzer et al. | 273/149 R |
| 2002/0084587 | A1 | 7/2002 | Bennett et al. | 273/309 |
| 2002/0111210 | A1 | 8/2002 | Luciano, Jr. et al. | 463/29 |
| 2002/0113371 | A1 | 8/2002 | Snow | 273/292 |
| 2002/0123376 | A1 | 9/2002 | Walker et al. | 463/11 |
| 2002/0142825 | A1 | 10/2002 | Lark et al. | 463/16 |
| 2002/0142846 | A1 | 10/2002 | Paulsen | 463/43 |
| 2002/0187821 | A1 | 12/2002 | Soltys et al. | 463/11 |
| 2002/0187825 | A1 | 12/2002 | Tracy et al. | 463/17 |
| 2002/0195773 | A1 | 12/2002 | Dunn | 273/274 |
| 2002/0195775 | A1 | 12/2002 | Webb et al. | 273/292 |
| 2003/0008697 | A1 | 1/2003 | Hartl | 463/11 |
| 2003/0027625 | A1 | 2/2003 | Rowe | 463/20 |
| 2003/0027638 | A1 | 2/2003 | Schneider et al. | 463/42 |
| 2003/0028480 | A1 | 2/2003 | Rowe | 705/39 |
| 2003/0032474 | A1 | 2/2003 | Kaminkow | 463/25 |
| 2003/0036425 | A1 | 2/2003 | Kaminkow et al. | 463/25 |
| 2003/0042679 | A1 | 3/2003 | Snow | 273/292 |
| 2003/0054881 | A1 | 3/2003 | Hedrick et al. | 463/29 |
| 2003/0064798 | A1 | 4/2003 | Grauzer et al. | 463/29 |
| 2003/0075869 | A1 | 4/2003 | Breeding et al. | 273/292 |
| 2003/0083126 | A1 | 5/2003 | Paulsen | 463/25 |
| 2003/0083132 | A1 | 5/2003 | Berg et al. | 463/40 |
| 2003/0130024 | A1 | 7/2003 | Darby | 463/13 |
| 2003/0176209 | A1 | 9/2003 | Soltys et al. | 463/13 |
| 2003/0176218 | A1 | 9/2003 | LeMay et al. | 463/25 |
| 2003/0186739 | A1 | 10/2003 | Paulsen et al. | 463/25 |
| 2003/0195037 | A1 | 10/2003 | Vuong et al. | 463/29 |
| 2003/0199320 | A1 | 10/2003 | Nguyen et al. | 463/42 |
| 2003/0212597 | A1 | 11/2003 | Ollins | 705/14 |
| 2003/0216165 | A1 | 11/2003 | Singer et al. | 463/20 |
| 2003/0232647 | A1 | 12/2003 | Moser | 463/29 |
| 2003/0236110 | A1 | 12/2003 | Beaulieu et al. | 463/1 |
| 2004/0002380 | A1 | 1/2004 | Brosnan et al. | 463/32 |
| 2004/0041346 | A1 | 3/2004 | Snow | 273/292 |
| 2004/0043820 | A1 | 3/2004 | Schlottmann | 463/43 |
| 2004/0061288 | A1 | 4/2004 | Snow | 273/274 |
| 2004/0072619 | A1 | 4/2004 | Brosnan et al. | 463/42 |
| 2004/0090003 | A1 | 5/2004 | Snow | 273/274 |
| 2004/0219982 | A1 | 11/2004 | Khoo et al. | 463/42 |
| 2004/0224777 | A1 | 11/2004 | Smith et al. | 463/47 |
| 2005/0026680 | A1 | 2/2005 | Gururajan | 463/25 |
| 2005/0051955 | A1 | 3/2005 | Schubert et al. | 273/149 R |
| 2005/0051965 | A1 | 3/2005 | Gururajan | 273/292 |
| 2005/0062226 | A1 | 3/2005 | Schubert et al. | 273/149 R |
| 2005/0062227 | A1 | 3/2005 | Grauzer et al. | 273/149 R |
| 2005/0073102 | A1 | 4/2005 | Yoseloff et al. | 273/292 |
| 2005/0098951 | A1 | 5/2005 | Groves | 273/292 |
| 2005/0101367 | A1 | 5/2005 | Soltys et al. | 463/12 |
| 2005/0116020 | A1 | 6/2005 | Smolucha et al. | 235/375 |
| 2005/0121852 | A1 | 6/2005 | Soltys et al. | 273/149 P |
| 2005/0137005 | A1 | 6/2005 | Soltys et al. | 463/13 |
| 2005/0227760 | A1 | 10/2005 | Vlazny et al. | 463/28 |
| 2005/0266919 | A1 | 12/2005 | Rowe et al. | 463/25 |
| 2005/0288083 | A1 | 12/2005 | Downs, III | 463/11 |
| 2005/0288084 | A1 | 12/2005 | Schubert | 463/11 |
| 2005/0288085 | A1 | 12/2005 | Schubert et al. | 463/11 |
| 2006/0027971 | A1 | 2/2006 | Radhakrishnan | 273/309 |

FOREIGN PATENT DOCUMENTS

| | | |
|---|---|---|
| EP | 1 291 045 A2 | 3/2003 |
| GB | 2 380 143 A | 4/2003 |
| WO | WO 97/36658 | 10/1997 |

| | | | |
|---|---|---|---|
| WO | WO 00/22585 | | 4/2000 |
| WO | WO 02/05914 | A1 | 1/2002 |
| WO | WO 02/051512 | A2 | 7/2002 |
| WO | WO 03/004116 | A1 | 1/2003 |
| WO | WO 03/060846 | A2 | 7/2003 |

OTHER PUBLICATIONS

U.S. Appl. No. 10/885,875, filed Jul. 7, 2004, Soltys et al.
U.S. Appl. No. 10/902,436, filed Jul. 29, 2004, Soltys et al.
U.S. Appl. No. 10/962,166, filed Oct. 8, 2004, Soltys et al.
U.S. Appl. No. 11/030,609, filed Jan. 5, 2005, Soltys et al.
U.S. Appl. No. 11/059,743, filed Feb. 16, 2005, Soltys et al.
U.S. Appl. No. 11/112,793, filed Apr. 21, 2005, Soltys et al.
U.S. Appl. No. 11/408,862, filed Apr. 21, 2006, Soltys et al.
U.S. Appl. No. 11/428,240, filed Jun. 30, 2006, Fleckenstein.
U.S. Appl. No. 11/428,253, filed Jun. 30, 2006, Fleckenstein.
U.S. Appl. No. 11/428,264, filed Jun. 30, 2006, Soltys.
U.S. Appl. No. 11/428,286, filed Jun. 30, 2006, Soltys et al.
U.S. Appl. No. 11/437,590, filed May 19, 2006, Soltys et al.
U.S. Appl. No. 11/478,360, filed Jun. 29, 2006, Fleckenstein.
U.S. Appl. No. 11/479,930, filed Jun. 30, 2006, Soltys et al.
U.S. Appl. No. 11/479,963, filed Jun. 29, 2006, Fleckenstein.
U.S. Appl. No. 11/479,988, filed Jun. 30, 2006, Shayesteh.
U.S. Appl. No. 11/479,991, filed Jun. 29, 2006, Soltys.
U.S. Appl. No. 11/480,273, filed Jun. 30, 2006, Soltys.
U.S. Appl. No. 11/480,274, filed Jun. 30, 2006, Huizinga.
U.S. Appl. No. 11/480,275, filed Jun. 30, 2006, Fleckenstein.
U.S. Appl. No. 11/480,295, filed Jun. 29, 2006, Fleckenstein.
U.S. Appl. No. 11/480,321, filed Jun. 30, 2006, Soltys.
U.S. Appl. No. 11/480,345, filed Jun. 30, 2006, Fleckenstein.
U.S. Appl. No. 11/480,349, filed Jun. 30, 2006, Soltys et al.
U.S. Appl. No. 11/519,244, filed Sep. 11, 2006, Soltys et al.
U.S. Appl. No. 60/838,280, filed Aug. 17, 2006, Soltys et al.
Bulavsky, J., "Tracking the Tables," *Casino Journal*, May 2004, pp. 44-47, accessed Dec. 21, 2005, URL=http://www.ascendgaming.com/cj/vendors_manufacturers_table/Trackin916200411141AM.htm, 5 pages.
Burke, A., "Tracking the Tables," reprinted from *International Gaming & Wagering Business*, Aug. 2003, 4 pages.
Gros, R., "All You Ever Wanted to Know About Table Games," reprinted from *Global Gaming Business*, Aug. 1, 2003, 2 pages.
Pro, L.V., "Book Review—The Card Counter's Guide to Casino Surveillance," *Blackjack Insider Newsletter*, May 2003, #40, accessed Aug. 25, 2006, URL=http:/bjinsider.com/newsletter_40_surveillance.shtml, 5 pages.
Scarne, J., *Scarne's Encyclopedia of Games*, Harper & Row, New York, 1973, p. 153.
Scarne, J., *Scarne's New Complete Guide to Gambling*, Simon & Schuster, Inc., New York, 1974, pp. 358-359.
Snyder, A., "The High-Tech Eye," excert from *Blackjack Forum*, Spring 1997, accessed Dec. 21, 2005, from Casino Software & Services, LLC, URL=http://www.casinosoftware.com/bj_forum.html.
Terdiman, D., "Who's Holding the Aces Now?", reprinted from *Wired News*, Aug. 18, 2003, 2 pages.
Ward, K., "BJ Tracking System has Players Down for the Count," *Gaming Today*, Mar. 5, 2002, accessed Dec. 21, 2005, from Casino Software & Services, LLC, URL=http://www.casinosoftware.com/gaming_today.html.
Winkler, C., "Product Spotlight: MindPlay," reprinted from *Gaming and Leisure Technology*, Fall 2003, 2 pages.
Bally TMS, "MP21—Automated Table Tracking/Features," 2 pages, Nov. 2005.
Bally TMS, "MPLite—Table Management System/Features," 2 pages, Nov. 2005.
Bravo Gaming Systems, "Casino Table Wager Analysis and Player Tracking System—Table Operations/Unique Features," accessed Apr. 11, 2005, URL=http://www.genesisgaming.com, 4 pages.
Casino Software & Services, LLC., accessed Aug. 25, 2006, URL=http:/casinosoftware.com/home.html, 6 pages.
Hewlett Packard Handhelds, accessed Sep. 8, 2003, URL=http:/www.shopping.hp.com/cgi-bin/hpdirect/shopping/scripts/home/store_acess.jsp?temp . . . , 2 pages.
International Guild of Hospitality & Restaurant Managers, "Shuffle Master, Inc. (NasdaqNM:SHFL)," accessed Dec. 30, 2003, URL=http://hospitalityguide.com/Financial/Casinos/Shuffle.htm, 3 pages.
Linksys WAP11 "Wireless Network Access Point," accessed Sep. 8, 2003, URL=http:/www.linksys.com/products/product.asp?prid=157&grid=, 4 pages.
MagTeck, "Port Powered Swipe Reader," Technical Reference Manual, Manual Part No. 99875094 Rev 12, Jun. 2003, 20 pages.
Mikohn, "Mikohn Tablelink—The Industry's Premier Table Tracking Solution Delivers Improvements Straight to the Bottom Line," 2 pages, before Jan. 1, 2004.
Mikohn, "Tablelink™, The New Standard in Table Games," before Jan. 1, 2004, 14 pages.
Semtek PDA & Handheld Devices, Compaq iSwipe™ Magnetic Card Reader, accessed Sep. 8, 2003, URL=http:/www.semtek.com/products/iswipe.html, 3 pages.
Plaintiff's Declaration of Lawrence Luciano in Opposition to Shuffle Master's Motion for Preliminary Injuction, *Card, LLC*v. *Shuffle Master, Inc.*, D. Nev. (No. CV-N-03-0244-ECR-(RAM)), Nov. 24, 2003.
Shuffle Master, Inc., "Shuffle Master Announces New Products; Intelligent Table System to Be Debuted at G2E," Sep. 10, 2003, 2 pages.
Shuffle Master, Inc., "Shuffle Master Gaming Presents The Ultimate Player Rating System . . . Bloodhound Sniffs Out the Pros and Cons," Dec. 31, 1997, 6 pages.

METHOD, APPARATUS AND ARTICLE FOR HIERARCHICAL WAGERING

CROSS-REFERENCE TO RELATED APPLICATION

This application is a continuation of U.S. patent application Ser. No. 10/061,636, filed Feb. 1, 2002, now pending, and claims the benefit under 35 U.S.C. § 119(e) of U.S. Provisional Patent Application No. 60/300,253, filed Jun. 21, 2001.

BACKGROUND OF THE INVENTION

1. Field of the Invention

This invention is generally related to wagering.

2. Description of the Related Art

A wager is an agreement under which each bettor pledges something against the outcome of an unsettled matter. For example, wagers are placed on the outcome of a game of skill or chance. Such games may include casino type table games, such as baccarat, blackjack or twenty-one, roulette, Caribbean stud poker, Tai Gow poker, Hi/Low, Let-It-Ride™, and craps. Such games may also include non-table games, such as slot machines and video poker. Additionally, wagers may be placed on the outcome of events, including sporting events such as horse racing and car racing, as well as various games such as baseball, football, basketball, golf and tennis.

Wagering can take place in many types of environments including controlled environments such as casinos, racetracks and licensed betting parlors, as well as in uncontrolled environments. Licensed wagering is a fast growing business, and is becoming increasingly prevalent on the World Wide Web portion of the Internet.

Each wager typically includes a set of odds setting the payout for a successful wager and approximately reflecting the probability of a particular outcome. Often the odds will include a bias in favor of the house. Often a winning or successful wager is paid an amount of money greater than the amount of the wager, as determined by the particular odds. For example, a successful wager of $50 at 2:1 odds is paid $100 or two times the wager amount. Many games of chance, such as roulette, craps and twenty-one permit different wagers at different odds. The number of options may prove daunting to a beginner, discouraging new players from learning to wager. Additionally, many casinos have more patrons during busy times than can be adequately handled at the various wagering or playing positions in the casino.

SUMMARY OF THE INVENTION

Under one aspect, a method, apparatus and article for wagering receives a primary wager from a primary player regarding an outcome of a gaming event, and receives a secondary wager from a secondary player regarding an outcome of the primary wager. The method, apparatus and article may also determine the outcome of the gaming event, determine the outcome of the primary wager based on the determined outcome of the gaming event, and determine the outcome of the secondary wager based on the determined outcome of the primary wager. The method, apparatus and article may additionally pay winnings to the primary player if the outcome of the primary wager is successful and collect the wager from the primary player if the outcome of the primary wager is unsuccessful. Also, the method, apparatus and article may pay winnings to the secondary player if the outcome of the secondary wager is successful, and collect the wager from the secondary player if the outcome of the secondary wager is unsuccessful. The method, apparatus and article may further determine statistics for the primary player based on the success of primary wagers placed by the primary player, and/or display the determined statistics for the primary player to at least the secondary player. Even further, the method, apparatus and article may determine odds for the secondary wager based at least in part on the success of a number of previous primary wagers placed by the primary player, and display the determined odds to at least the secondary player. Yet further still, the method, apparatus and article may receive a tertiary wager from a tertiary player regarding an outcome of the secondary wager of the secondary player.

Thus, the wagering method, apparatus and article may allow beginners, or others, to wager based on another's wagers, taking advantage of another player's skill, knowledge or luck. The wagering method, apparatus and article may permit secondary wagers to be placed from the same location as the primary wager, or from remote locations.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with computers, servers, networks, imagers, and gaming or wagering apparatus have not been shown or described in detail to avoid unnecessarily obscuring descriptions of the embodiments of the invention.

Unless the context requires otherwise, throughout the specification and claims which follow, the word "comprise" and variations thereof, such as, "comprises" and "comprising" are to be construed in an open, inclusive sense, that is as "including, but not limited to."

The headings provided herein are for convenience only and do not interpret the scope or meaning of the claimed invention.

Wagering Environment Overview

Figure 1:
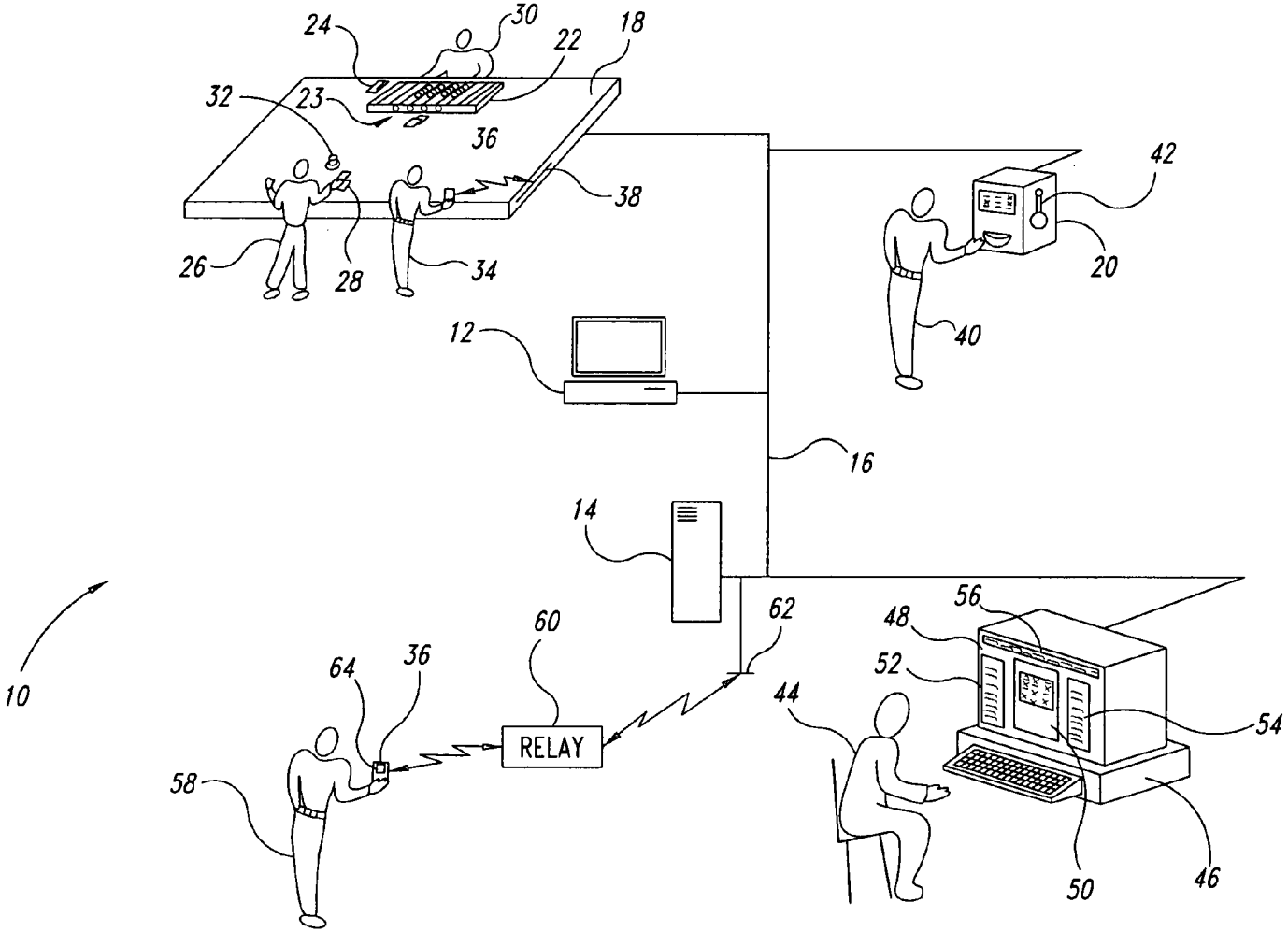
FIG. 1 is a schematic overview of a wagering system according to one illustrated embodiment of the invention.

FIG. 1 shows a wagering system 10 including a host computing system 12, a server 14 and a network 16. The server 14 and network 16 couple the host computing system 12 to various gaming sensors, gaming actuators and/or gaming processors at a number of different wagering or gaming positions. The gaming positions are the locations where the actual gaming events occur, such as the dealing cards, rolling of dice, spinning of wheels, running of races or playing of games. For example, gaming positions may include gaming tables such as a twenty-one or blackjack table 18, or gaming machines such as a slot machine 20.

The gaming sensors, gaming actuators and/or gaming processors and other electronics can be located in the gaming table, and/or various devices on the gaming table such as the chip tray 22 and card reader 24. For example, suitable hardware and software for playing card based games such as twenty-one are described in commonly assigned pending U.S. patent applications: Ser. No. 60/130,368, filed Apr. 21, 1999; Ser. No. 09/474,858, filed Dec. 30, 1999, entitled "METHOD AND APPARATUS FOR MONITORING CASINO GAMING"; Ser. No. 60/259,658, filed Jan. 4, 2001; Ser. No. 09/849,456, filed May 4, 2001; and Ser. No. 09/790,480, filed Feb. 21, 2001, entitled "METHOD, APPARATUS AND ARTICLE FOR EVALUTING CARD GAMES, SUCH AS BLACKJACK".

A first player 26 can place a primary wager directly on the outcome of the gaming event, such as the outcome of a hand of playing cards 28 dealt by a dealer 30 in a game of twenty-one. Thus, the first player 26 is denominated herein as a primary player since the first player 26 is placing a primary wager. The first player 26 may place the wager by locating wagering pieces such as one or more chips 32 in an appropriate location on the blackjack table 18.

A second player 34 can place a secondary wager on the outcome of one or more of the first player's 26 primary wagers. Thus, the second player 34 is denominated herein as a secondary player. The second player 34 may employ a player computer such as a hand-held communications device 36 to wirelessly transmit secondary wager related information to the host computing system 12. The handheld communications device 36 can be a general purpose device capable of wireless communications, such as a cellular telephone, a personal data assistant ("PDA"), a pager, and/or a BLUETOOTH configured device. Alternatively, the wireless communications device 36 may be a device specially configured for wagering employing, for example, the Wireless Application Protocol ("WAP"). The second player 34 may place the secondary wager from same gaming position that the primary wager is placed from, or from a remote location. The wireless communications device 36 may transmit to the host computer 12 via the server 14 by way of an antenna 38 located at, or proximate, the gaming position. For example, the antenna 38 can be carried by the blackjack table 18. Use of the wireless communications device 36 permits a casino to receive additional wagering without incurring the infrastructure cost of providing additional gaming tables or space. This may assist casinos in handling the large crowds which typically occur on weekends and holidays at many casinos.

A third player 40 can place a primary wager on the direct outcome of a play of the slot machine 20. The third player 40 is thus denominated herein as a primary player, placing a wager directly on the outcome of the gaming event. The third player 40 can place the wager by, for example, by placing coins, tokens or other currency into the appropriate receiver of the slot machine 20 and operating a handle 42 or other buttons, keys or switches. Mechanical and digital slot machines are known to those skilled in the relevant art so will not be further discussed in the interest of brevity.

A fourth player 44 can place a secondary wager on the outcome of one or more of the third player's 40 wagers. The fourth player 44 is thus denominated herein as a secondary player. The fourth player 44 may also place a secondary wager on the outcome of one or more of the first player's 26 wagers, either concurrently with, or separately from, the secondary wagering on the third player's 40 wagers. The fourth player 44 may, for example, place the secondary wager from a remote location, such as the fourth player's home, office or a retail wagering location such as a licensed or unlicensed betting parlor.

The fourth player 44 can place the wager via a player computer such as a desktop or laptop personal computer 46. The personal computer 46 may communicate with the server 14 over any standard communications channels, such as the public telephone exchange ("PBX"), cable network ("CATV"), T1 or T2 lines, satellite and/or other communications channels. The personal computer 46 can include a display 48 for displaying a simulation of the gaming event, such as a simulated view 50 of the actual slot machine 20. The simulated view 50 can represent the actual gaming event in real time, or almost real time. The display 48 can also display statistics 52 for one or more of the primary players 26, 40, and statistics 54 for the fourth player's 44 secondary wagering. Additionally, the display 48 can carry advertisements 56, such as casino and travel discounts, as well as other information relevant to the fourth player.

A fifth player 58 may place tertiary wagers on the outcomes of one or more of the secondary wagers by the second and/or fourth players 34, 44. Thus, the fifth player 58 is denominated herein as a tertiary player. Additionally, or alternatively, the fifth player 58 may place secondary wagers on the outcomes of the wagers by either the first and/or the third players 26, 40. The fifth player 58 may be present at one of the gaming positions 18, 20, or may be in a remote location, such as elsewhere in a casino. The fifth player 58 may employ a wireless hand-held communications device 36 that communicates to the server 14 via a relay 60 and a receiver such as an antenna 62. The wireless communications device 36 can include a display 64. The display 64 can display information similar to the information displayed by the display 48 of the personal computer 46. The information may be reformatted to fit the smaller display 66 of the wireless communications device 36.

Figure 2:
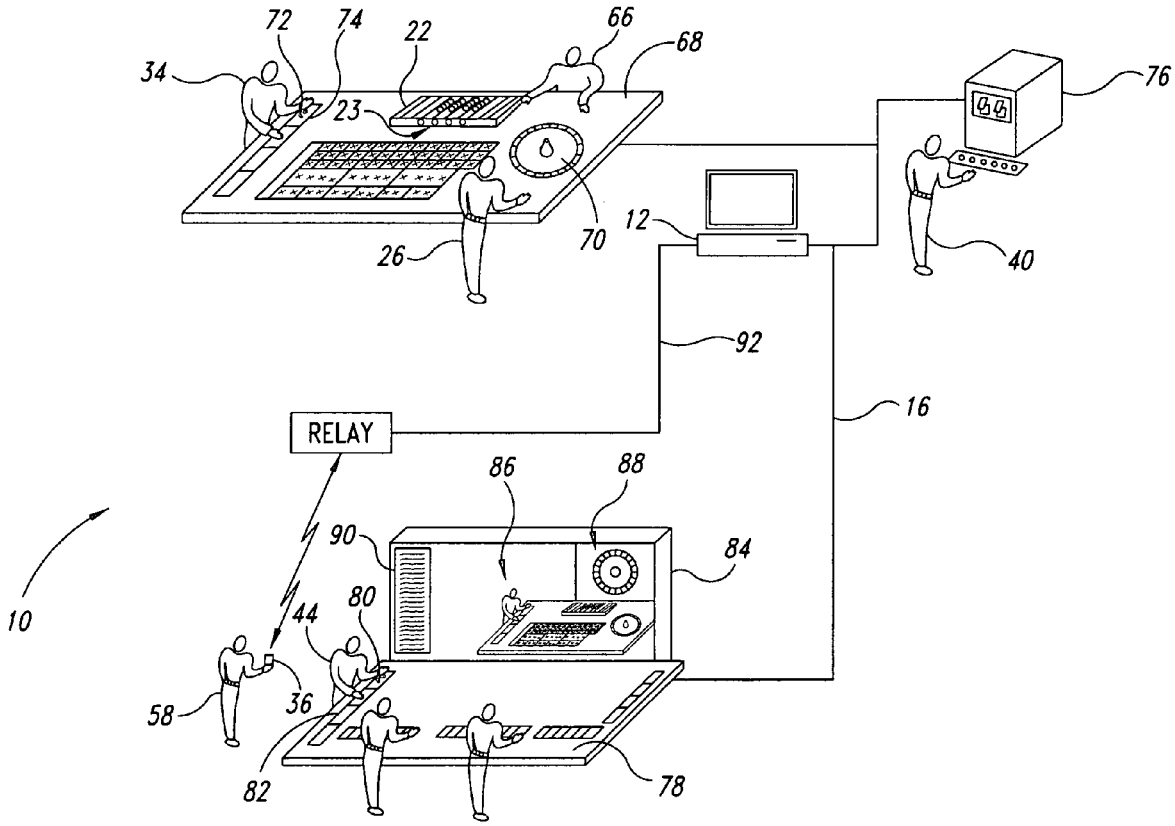
FIG. 2 is a schematic overview of the wagering system according to a second illustrated alternative embodiment.

FIG. 2 shows an alternative embodiment of the wagering system 10. This alternative embodiment, and those alternative embodiments and other alternatives described herein, are substantially similar to previously described embodiments, and common acts and structures are identified by the same reference numbers. Only significant differences in operation and structure are described below.

In FIG. 2, the wagering system 10 does not employ a separate server 14 for providing communications between the host computer 12 and the various gaming positions. The first player 26 places a primary wager with the table operator 66 at a roulette table 68. A chip tray 22 can carry suitable electronics for capturing the wagering. Additionally, electronics can be built into a roulette wheel 70 to capture the gaming event information, as is described in U.S. Pat. No. 5,770,533 issued Jun. 23, 1998 to Franchi and U.S. Pat. No. 5,801,766 issued Sep. 1, 1998 to Alden. The second player 34 places a secondary wager by placing wagering pieces such as chips 72 in a specially delimited area 74 of the roulette table 68. Other table games can employ similar delimited areas for placing secondary wagers.

The third player 40 places primary wagers via a video poker machine 76. The structure and operation of video poker machines are known by those skilled in the relevant art so will not be further discussed in the interest of brevity.

The fourth player 44, as well as additional players (not called out in the Figures) can place secondary wagers at a secondary wagering table 78. The secondary wagering table 78 may be in the same room in a casino as the roulette table 68, or may be in a different room in the casino, or may even be remote from the casino, for example in another town or city.

The fourth player 44 places the secondary wager by, for example, placing wagering pieces such as markers or chips 80 in an appropriate delimited area 82 on the secondary wagering table 78. A wagering display 84 displays information to the fourth player 44 regarding the gaming and the primary wagering at the roulette table 68. For example, the wagering display 84 may include a live video image 86 of the play at the roulette table 68. The wagering display 84 may also include an inset or a picture in a picture live or simulated image 88 of the roulette wheel 70. The wagering display 84 can display these images 86, 88 in real-time, or almost in real-time. Further, the wagering display 84 can display statistical information 90 regarding the outcome of gaming events at the roulette table 68, the outcome of primary wagers, and/or the outcome of the secondary wagers. Additionally, the statistical information 90 may include statistical information for one or more of the players 26, 34, 44. Further, the wagering display 84 can include advertising and/or other information relevant to the player 44. The wagering display 84, or an additional wagering display (not shown), can display images and/or statistical information for other gaming events, permitting the fourth player 44 to wagering on multiple different gaming events at a same time.

The fifth player 58 may place tertiary wagers based on the outcome of the secondary wagers. Again the fifth or tertiary player 58 may employ a hand-held device 36 to communicate with the host computing system 12 via relay 44. In this embodiment, the relay 44 is coupled to the host computing system 12 via a local area network 92. Alternatively, the casino may allow the fifth player 58 place the tertiary wagers directly at the secondary wagering table 78 or even at the roulette table 68, where specially delimited areas of the table are provided for such purpose.

System Hardware

Figure 3:
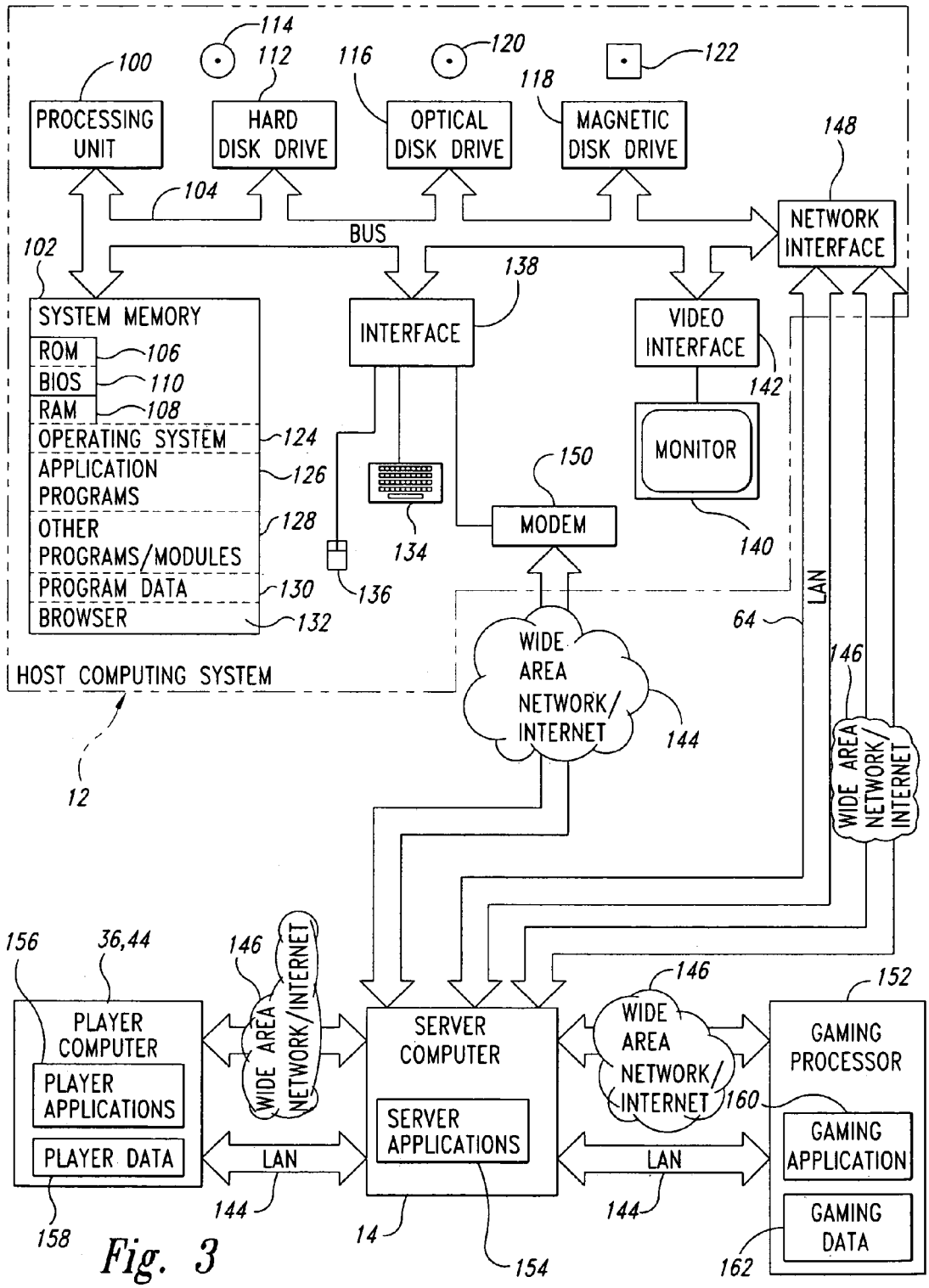
FIG. 3 is a functional block diagram of the wagering system of FIG. 1.
Figure 4A:
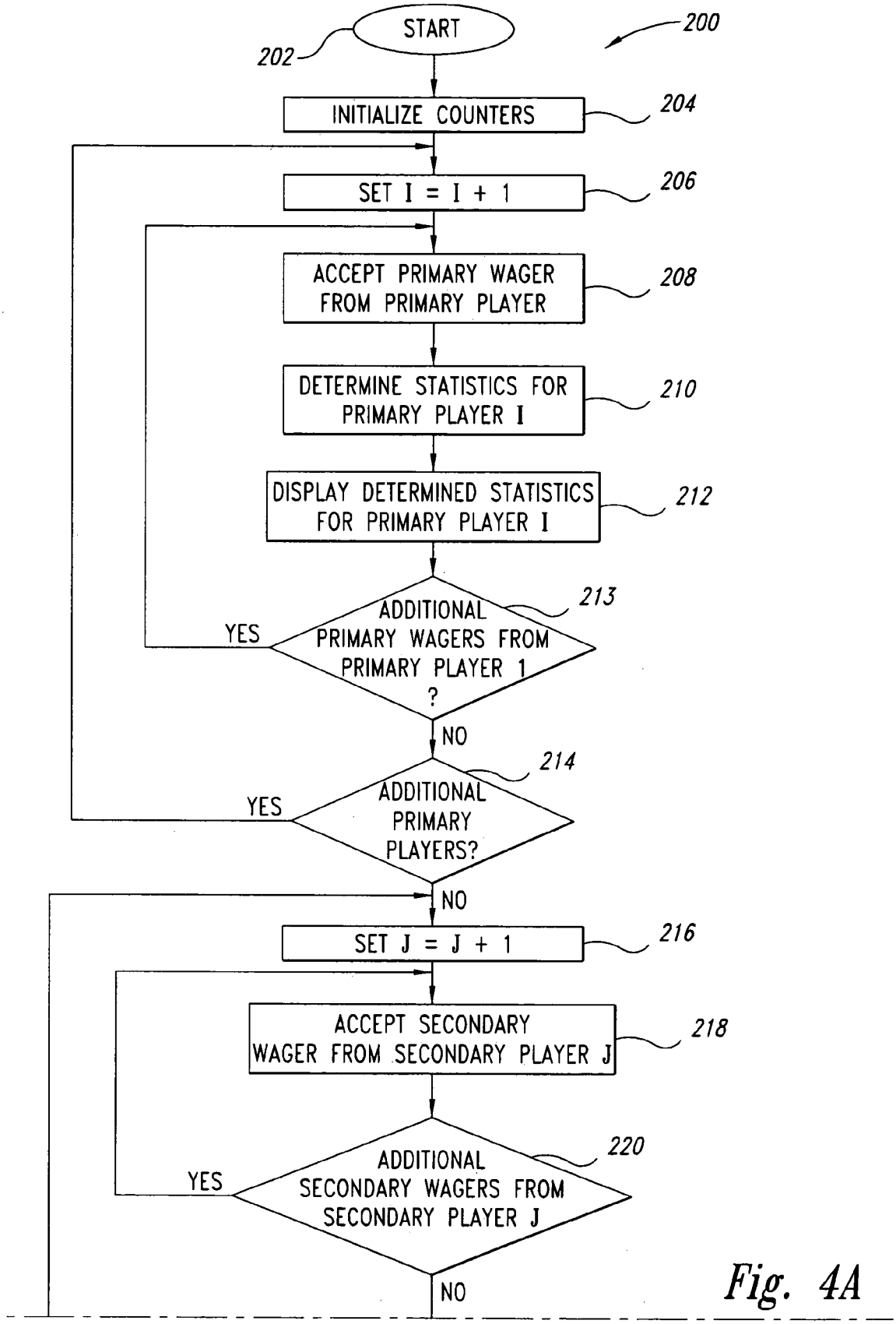
FIGS. 4A-4G are a flow diagram showing a method of operating the wagering system of FIG. 1.
Figure 4B:
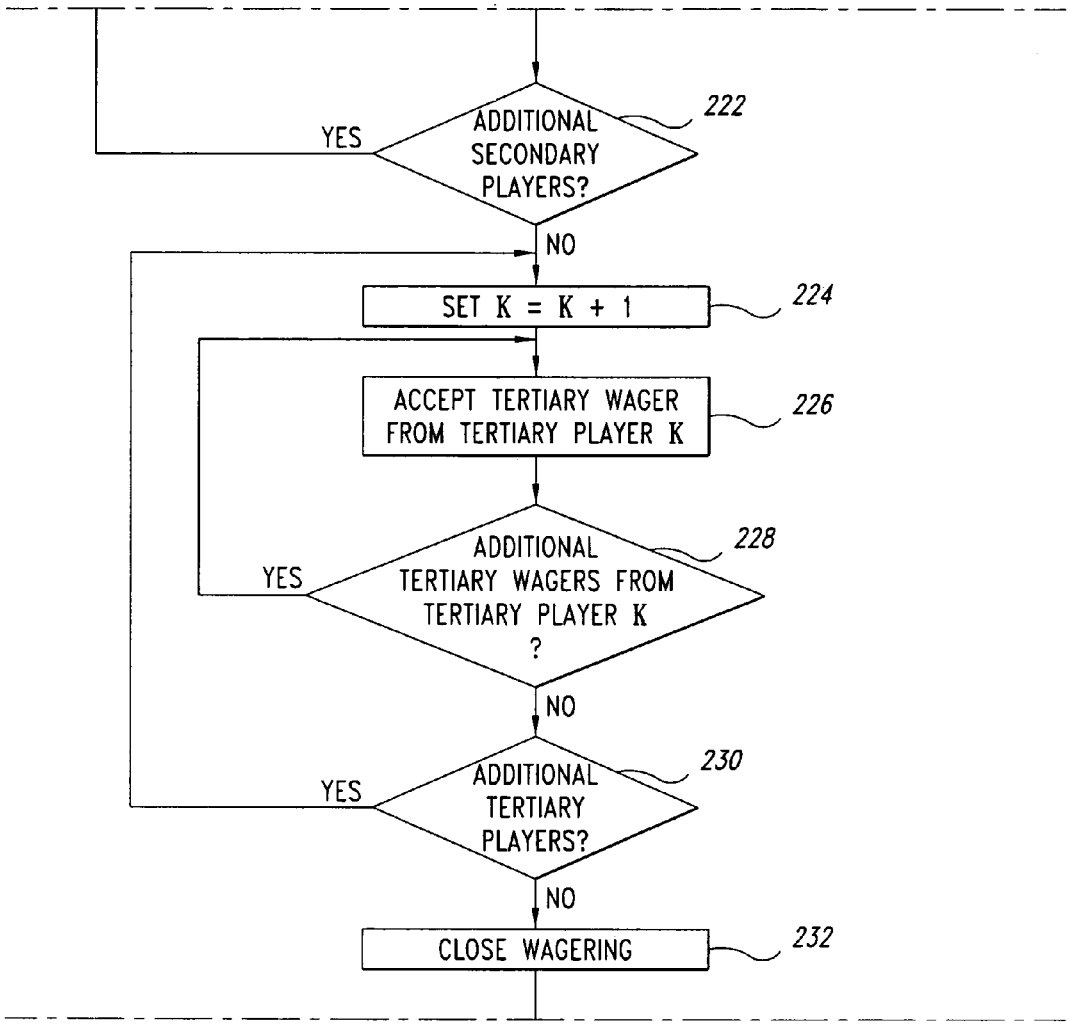
Figure 4C:
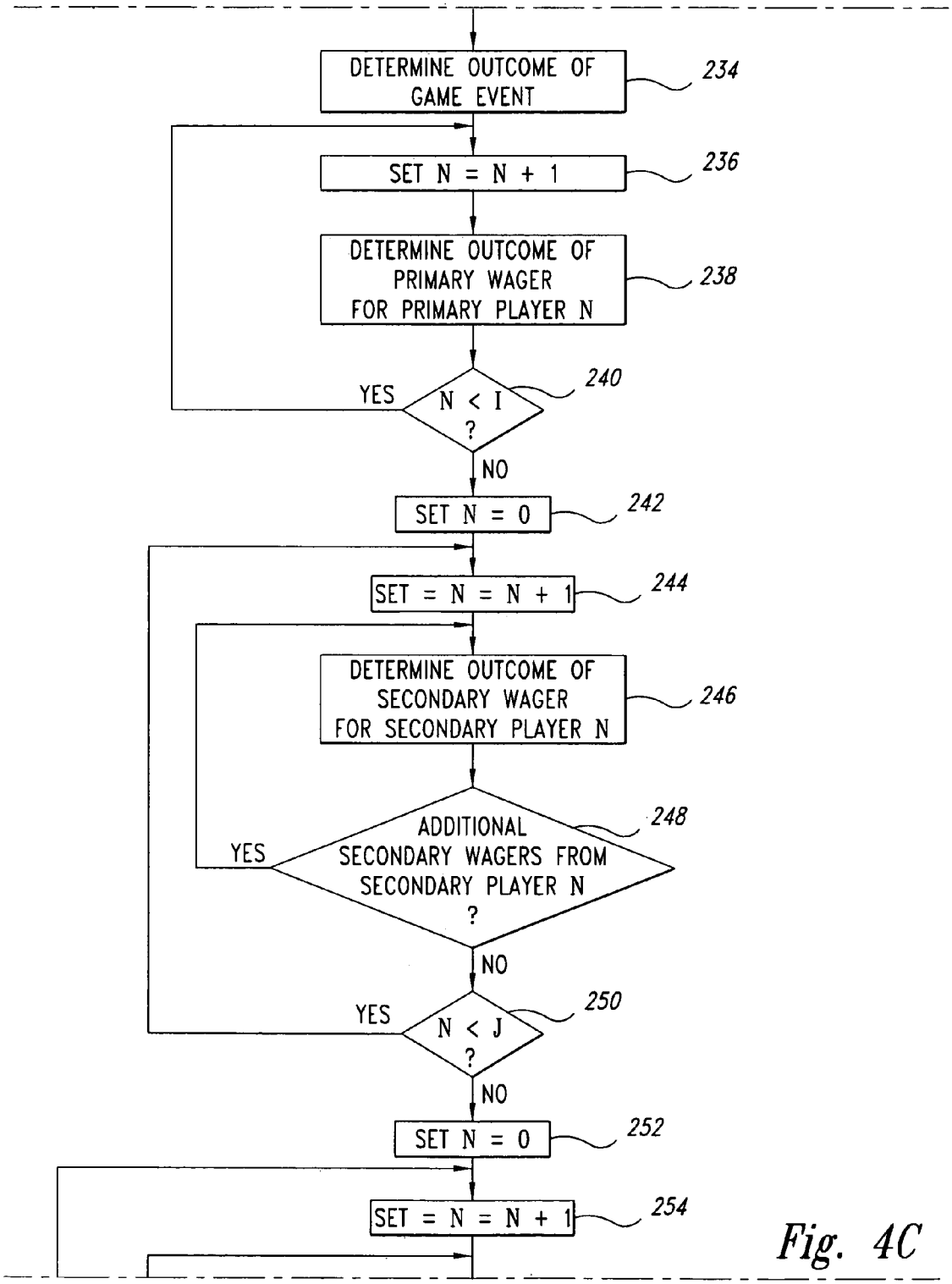
Figure 4D:
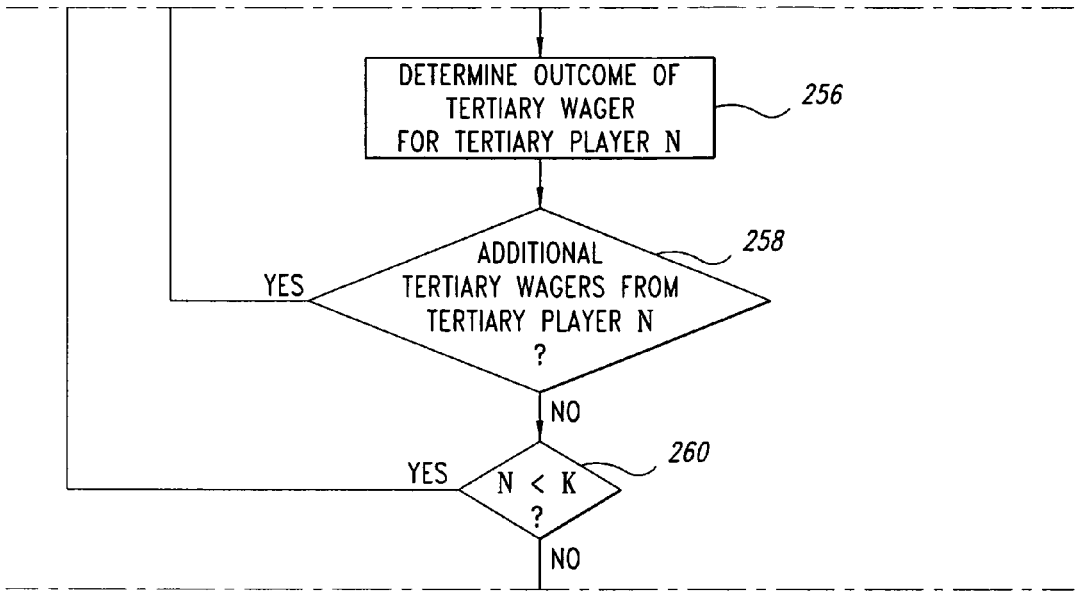
Figure 4E:
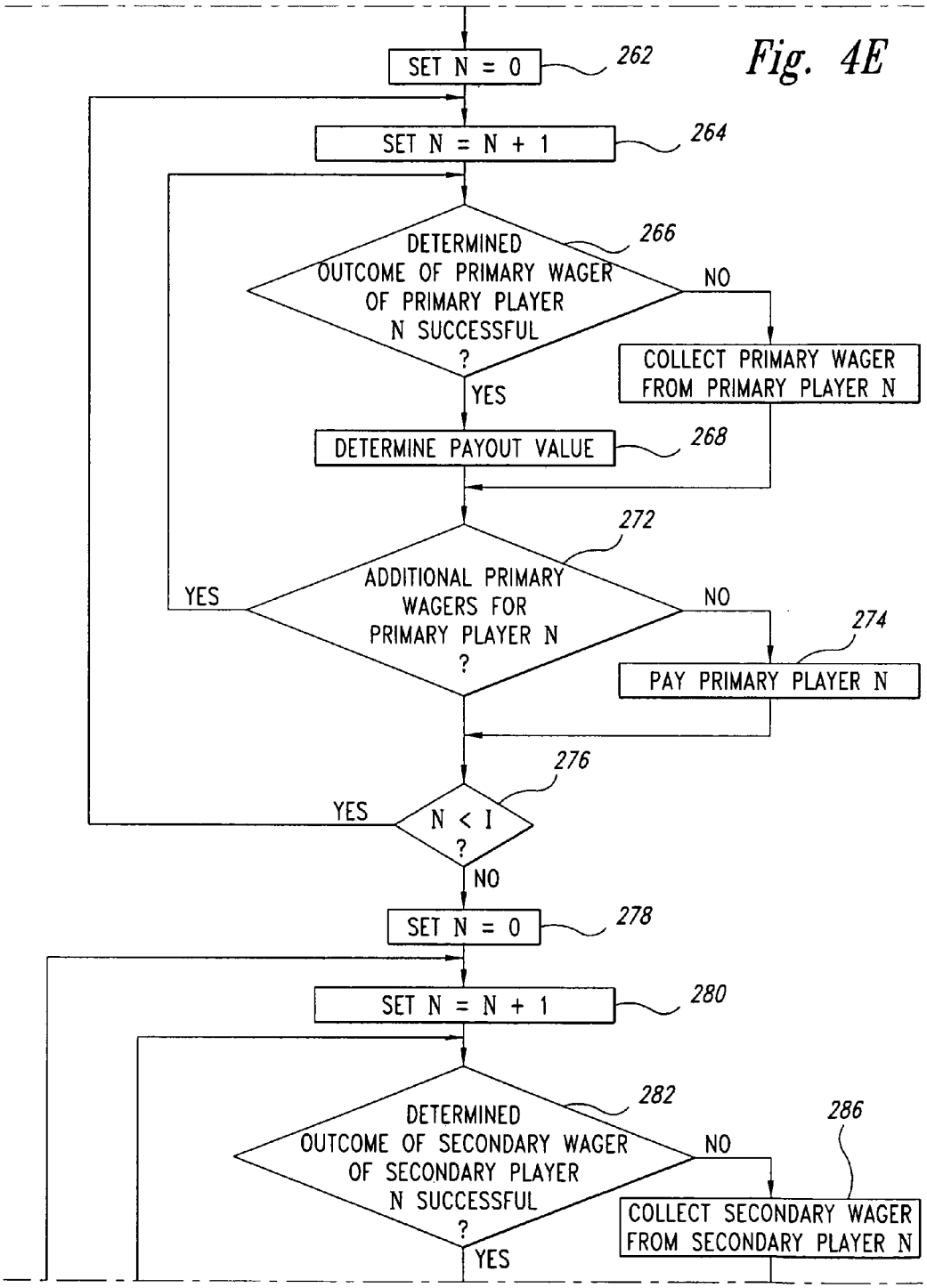
Figure 4F:
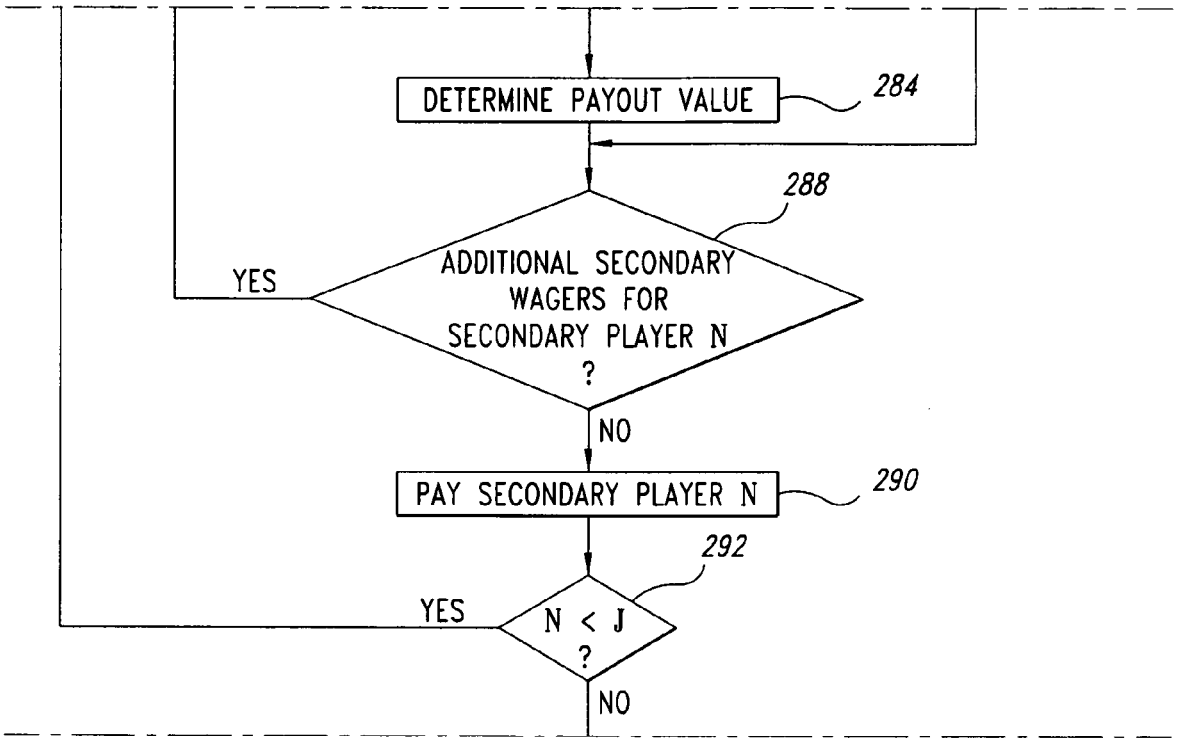
Figure 4G:
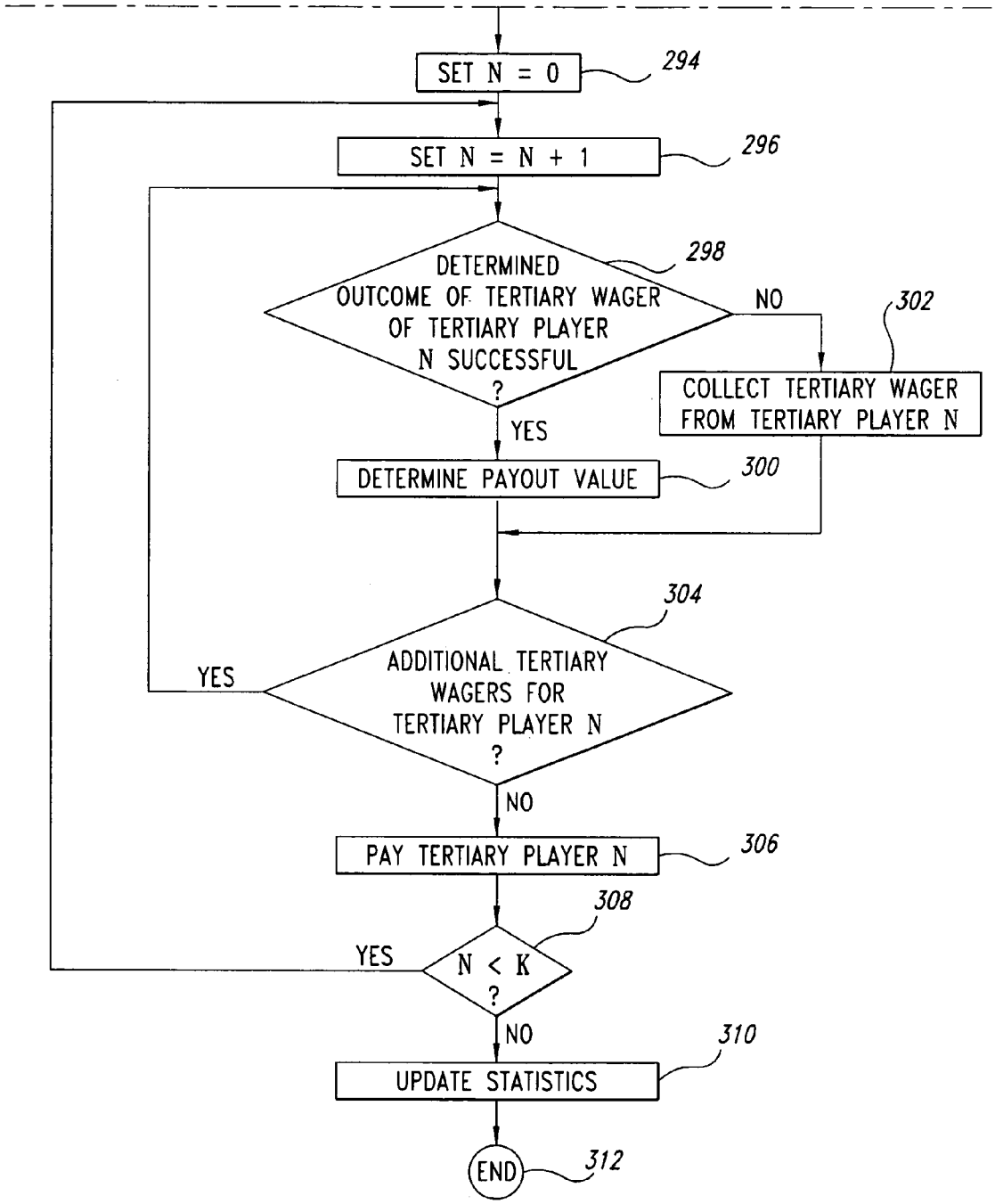

FIG. 3 and the following discussion provide a brief, general description of a suitable computing environment in which embodiments of the invention can be implemented. Although not required, embodiments of the invention will be described in the general context of computer-executable instructions, such as program application modules, objects, or macros being executed by a computer. Those skilled in the relevant art will appreciate that the invention can be practiced with other computer system configurations, including hand-held devices, multiprocessor systems, microprocessor-based or programmable consumer electronics, personal computers ("PCs"), network PCs, mini computers, mainframe computers, and the like. The invention can be practiced in distributed computing environments where tasks or modules are performed by remote processing devices, which are linked through a communications network. In a distributed computing environment, program modules may be located in both local and remote memory storage devices.

Referring to FIG. 1, a conventional mainframe or minicomputer, referred to herein as the host computing system 12, includes a processing unit 100, a system memory 102 and a system bus 104 that couples various system components including the system memory 102 to the processing unit 100. The host computing system 12 will at times be referred to in the singular herein, but this is not intended to limit the application of the invention to a single host computer since in typical embodiments, there will be more than one host computer or other device involved. The wagering system 10 may employ other computers, such as conventional personal computers, where the size or scale of the system allows. The processing unit 100 may be any logic processing unit, such as one or more central processing units (CPUs), digital signal processors (DSPs), application-specific integrated circuits (ASICs), etc. Unless described otherwise, the construction and operation of the various blocks shown in FIG. 1 are of conventional design. As a result, such blocks need not be described in further detail herein, as they will be understood by those skilled in the relevant art.

The system bus 104 can employ any known bus structures or architectures, including a memory bus with memory controller, a peripheral bus, and a local bus. The system memory 102 includes read-only memory ("ROM") 106 and random access memory ("RAM") 108. A basic input/output system ("BIOS") 110, which can form part of the ROM 106, contains basic routines that help transfer information between elements within the host computing system 12, such as during start-up.

The host computing system 12 also includes a hard disk drive 112 for reading from and writing to a hard disk 114, and an optical disk drive 116 and a magnetic disk drive 118 for reading from and writing to removable optical disks 120 and magnetic disks 122, respectively. The optical disk 120 can be a CD-ROM, while the magnetic disk 122 can be a magnetic floppy disk or diskette. The hard disk drive 112, optical disk drive 116 and magnetic disk drive 118 communicate with the processing unit 100 via the bus 104. The hard disk drive 112, optical disk drive 116 and magnetic disk drive 118 may include interfaces or controllers (not shown) coupled between such drives and the bus 104, as is known by those skilled in the relevant art. The drives 112, 116 and 118, and their associated computer-readable media, provide nonvolatile storage of computer readable instructions, data structures, program modules and other data for the host computing system 12. Although the depicted host computing system 12 employs hard disk 112, optical disk 116 and magnetic disk 118, those skilled in the relevant art will appreciate that other types of computer-readable media that can store data accessible by a computer may be employed, such as magnetic cassettes, flash memory cards, digital video disks ("DVD"), Bernoulli cartridges, RAMs, ROMs, smart cards, etc.

Program modules can be stored in the system memory 102, such as an operating system 124, one or more application programs 126, other programs or modules 128 and program data 130. The system memory 102 may also include a Web client or browser 132 for permitting the host computing system 12 to access and exchange data with sources such as web sites of the Internet, corporate intranets, or other networks as described below, as well as other server applications on server computers such as those further discussed below. The browser 132 in the depicted embodiment is markup language based, such as Hypertext Markup Language (HTML), Extensible Markup Language (XML) or Wireless Markup Language (WML), and operates with markup languages that use syntactically delimited characters added to the data of a document to represent the structure of the document. A number of Web clients or browsers are commercially available such as NETSCAPE NAVIGATOR from America Online, and INTERNET EXPLORER available from Microsoft of Redmond, Wash.

While shown in FIG. 1 as being stored in the system memory 102, the operating system 124, application programs 126, other programs/modules 128, program data 130 and browser 132 can be stored on the hard disk 114 of the hard disk drive 112, the optical disk 120 of the optical disk drive 116 and/or the magnetic disk 122 of the magnetic disk drive 118. An operator, such as casino personnel, can enter commands and information into the host computing system 12 through input devices such as a keyboard 134 and a pointirig device such as a mouse 136. Other input devices can include a microphone, joystick, game pad, scanner, etc. These and other input devices are connected to the processing unit 100 through an interface 138 such as a serial port interface that couples to the bus 104, although other interfaces such as a parallel port, a game port or a wireless interface or a universal serial bus ("USB") can be used. A monitor 140 or other display device is coupled to the bus 104 via a video interface 142, such as a video adapter. The host computing system 12 can include other output devices, such as speakers, printers, etc.

The host computing system 12 can operate in a networked environment using logical connections to one or more remote computers, such as the server computer 14. The server computer 14 can be another personal computer, a server, another type of computer, or a collection of more than one computer communicatively linked together and typically includes many or all of the elements described above for the host computing system 12. The server computer 14 is logically connected to one or more of the host computing systems 12 under any known method of permitting computers to communicate, such as through a local area network ("LAN") 144, or a wide area network ("WAN") or the Internet 146. Such networking environments are well known in wired and wireless enterprise-wide computer networks, intranets, extranets, and the Internet. Other embodiments include other types of communication networks including telecommunications networks, cellular networks, paging networks, and other mobile networks.

When used in a LAN networking environment, the host computing system 12 is connected to the LAN 144 through an adapter or network interface 148 (communicatively linked to the bus 104). When used in a WAN networking environment, the host computing system 12 may include a modem 150 or other device, such as the network interface 148, for establishing communications over the WAN/Internet 146. The modem 150 is shown in FIG. 1 as communicatively linked between the interface 138 and the WAN/Internet 144. In a networked environment, program modules, application programs, or data, or portions thereof, can be stored in the server computer 14. In the depicted embodiment, the host computing system 12 is communicatively linked to the server computer 14 through the LAN 144 or the WAN/Internet 146 with TCP/IP middle layer network protocols; however, other similar network protocol. layers are used in other embodiments, such as User Datagram Protocol ("UDP"). Those skilled in the relevant art will readily recognize that the network connections shown in FIG. 1 are only some examples of establishing communication links between computers, and other links may be used, including wireless links.

The server computer 14 is also communicatively linked to one or more player computers 36, 44, such as the wireless communications device 36 or desktop computer 46 (FIG. 1), typically through the LAN 144 or the WAN/Internet 146 or other networking configuration such as a direct asynchronous connection (not shown). The server computer 14 is further communicatively linked to the sensors, actuators and processors of one or more gaming positions, identified collectively as gaming processor 152, typically through the LAN 144 or the WAN/Internet 146 or other networking configuration such as a direct asynchronous connection (not shown).

The server computer 14 includes server applications 154 for the routing of instructions, programs, data and agents between the player computers 36, 44 and the host computing system 12, and between the gaming processors 152 and the host computing system 12. For example the server applications 154 may include conventional server applications such as WINDOWS NT 4.0 Server, and/or WINDOWS 2000 Server, available from Microsoft Corporation or Redmond, Wash. Additionally, or alternatively, the server applications 154 can include any of a number of commercially available Web servers, such as INTERNET INFORMATION SERVICE from Microsoft Corporation and/or IPLANET from Netscape.

The player computers 36, 44 include player applications 156 and player data 158. The player applications 156 can include instructions for handling security such as password or other access protection and communications encryption. The player applications 156 can also include statistical packages for manipulating data about the performance of the various players, including the performance owner of the operator of the player computer 36, 46. The player applications 156 can further include instructions for displaying information received from the host computing system 12 via the server 14 in a suitable format to fit the particular user interface of the player computer 36, 44, and/or for transmitting a wager to the host computing system 12. Player data 158 can include, for example, player identification data, preference data, statistical data for the particular player and/or other players, account numbers, account balances, maximum and/or minimum wagers, etc.

The gaming processor 152 can include gaming applications 160 and gaming data 162. The gaming applications 160 can include instructions for acquiring wagering and gaming event information from the live gaming at the game position, such as instructions for acquiring an image of the wagers, identifiers on playing cards, position of a ball in the roulette wheel 70, and/or reels on a slot machine 20. The gaming applications 160 can also include instructions for processing, at least partially, the acquired wagering and gaming event information, for example, identifying the position and size of each wager and/or the value of each hand of playing cards. Suitable applications are described in one or more of commonly assigned U.S. patent applications: Ser. No. 60/130368, filed Apr. 21, 1999; Ser. No. 09/474,858 filed Dec. 30, 1999, entitled "METHOD AND APPARATUS FOR MONITORING CASINO GAMING"; Ser. No. 60/259,658, filed Jan. 4, 2001; Ser. No. 09/849456 filed May 4, 2001, Ser. No. 09/790480, filed Feb. 21, 2001, entitled "METHOD, APPARATUS AND ARTICLE FOR EVALUTING CARD GAMES, SUCH AS BLACKJACK". The gaming applications 160 statistical packages for producing statistical information regarding the play at a particular gaming table, the performance of one or more players, and/or the performance of the dealer 30 and/or game operator 66. The gaming applications can also include instructions for providing a video feed of some or all of the gaming position. Gaming data may include outcomes of games, amounts of wagers, average wager, player identity information, complimentary benefits information ("comps"), player performance data, dealer performance data, chip tray accounting information, playing card sequences, etc.

Thus, the server 12 can route wagering related information between the gaming positions and the host computing system 12, and between the host computing system 12 and remote players to provide a hierarchical wagering environment.

Wagering System Operation

FIGS. 4A-4G show a method 200 of operation for the wagering system 10. The method handles multiple primary players, secondary players and tertiary players. The secondary players can place secondary wagers on one or more of the primary wagers, while the tertiary players can place tertiary wagers on one or more secondary wagers. The method 200 starts in step 202 and in step 204 the processing unit 100 initializes a set of counters.

In step 206, the processing unit 100 increments the a first counter I (i.e., I=I+1) in preparation for receiving the primary wagers by the primary players. In step 208, the processing unit 100 receives a primary wager from a primary player I. In step 210, the processing unit 100 determines statistics for the primary player I. The processing unit 100 may rely on previously stored statistical information for the primary player I and/or may be keeping statistics as successive games are played. In step 212, the processing unit 100 displays the determined statistics for the primary player I, for example on the display 36 of the handheld wireless communications device 36 (FIG. 1) or the wagering display 84 (FIG. 2).

In step 213, the processing unit 100 determines if there are additional primary wagers from the primary player I. If there are additional primary wagers from the primary player I, the processing unit 100 passes control back to step 208. If there are not additional primary wagers for the primary player I, the processing unit 100 passes controller to step 214 where the processing unit 100 determines whether there are additional primary players. If there are additional primary players, the processing unit 100 passes control to step 206, where the counter I is incremented (i.e., I=I+1). If there are no additional primary players, the processing unit 100 passes control to step 216, the counter I storing the number of primary players.

In step 216, the processing unit 100 increments the counter J (i.e., J=J+1) in preparation for receiving the secondary wagers by the secondary players. In step 218, the processing unit 100 receives the secondary wager from secondary player J. In step 220, the processing unit 100 determines if there are additional secondary wagers from the secondary player J. If there are additional secondary wagers from the secondary player J, the processing unit 100 passes control back to step 218. If there are not additional secondary wagers, the processing unit 100 passes control to step 222 where the processing unit 100 determines if there are additional secondary players. If there are additional secondary players, the processing unit 100 passes control to step 216 where the counter J is incremented (i.e., J=J+1). If there are no additional secondary players, the processing unit 100 passes control to step 224, the counter J storing the number of secondary players.

In step 224, the processing unit 100 increments the counter K (i.e., K=K+1) in preparation for receiving the tertiary wagers by the tertiary players. In step 226, the processing unit 100 receives the tertiary wager from tertiary player K. In step 228, the processing unit 100 determines if there are additional tertiary wagers from the tertiary player K. If there are additional tertiary wagers from the tertiary player K, the processing unit 100 passes control back to step 226. If there are no additional tertiary wagers, the processing unit 100 passes control to step 230. In step 230, the processing unit 100 determines if there are additional tertiary players. If there are additional tertiary players, the processing unit 100 passes control to step 224 where the counter K is incremented (i.e., K=K+1). If there are no additional tertiary players, the processing unit 100 passes control to step 232, where wagering is closed. The counter K thus stores the number of tertiary players.

In step 234, the processing unit 100 of the host computing system 12 determines the outcome of a gaming event. The precise method of determining the outcome of the gaming event will depend on the game, and possibly other factors. The processing unit 100 may receive and process raw gaming information collected by various sensors such as imagers at the gaming positions. Alternatively, the wagering system 10 may distribute the processing by having the gaming processors 152 at the various gaming positions process the raw gaming information and providing processed gaming information such as the outcome of the gaming event to the processing unit 100 of the host computing system 12. Distributing the processing to the gaming processors 152 reduces the workload on the processor 100 allowing a smaller processor to handle more wagering, and perhaps providing faster results. However, retaining processing at the processing unit 100 may provide better control over the software, and may make changes to the software simpler. The wagering system 10 may also employ a mix of above approaches, for example, retaining processing at the processor 100 for some gaming, while distributing the processing to the gaming processor 152 for other gaming.

An example of determining the outcome of a gaming event is determining the outcome of a hand of cards in a game of twenty-one or blackjack. The rules of twenty-one are well-known to those skilled in the art. In general, the total value of the player's hand and the dealer's hand are determined. It is then determined whether either the player or the dealer has busted (i.e., the value of the hand exceeds twenty-one). If the player has busted the outcome is a loss for the player. If the dealer has busted and the player has not, the outcome is a win for the player. If neither the player or the dealer have busted, the value of the player's hand is compared to the dealer's hand. If the player has the higher value hand, the outcome is a win for the player. If the dealer has the higher value hand, the outcome is a loss for the player. If player and the dealer have hands of equal value, the outcome is a push (i.e., tie). Suitable systems and methods for determining the outcome of gaming events for twenty-one, and for determining the wagering are taught in commonly assigned U.S. patent applications: Ser. No. 60/130,368, filed Apr. 21, 1999; Ser. No. 09/474,858, filed Dec. 30, 1999, entitled "METHOD AND APPARATUS FOR MONITORING CASINO GAMING"; Ser. No. 60/259,658, filed Jan. 4, 2001; Ser. No. 09/849,456, filed May 4, 2001; and Ser. No. 09/790,480, filed Feb. 21, 2001, entitled "METHOD, APPARATUS AND ARTICLE FOR EVALUTING CARD GAMES, SUCH AS BLACKJACK". Other methods of determining the outcome of gaming events are taught in U.S. Pat. No. 5,770,533, issued Jun. 23, 1998, to Franchi, and U.S. Pat. No. 5,801,766, issued Sep. 1, 1998, to Alden.

In step 236, the processing unit 100 increments a counter N (i.e., N=N+1) in preparation for processing the primary wagers. In step 238, the processing unit 100 determines the outcome of the primary wager for the primary player N.

Determining the outcome of the primary wager typically includes comparing the determined outcome of the gaming event to the outcome wagered on by the primary player. For example, in the game twenty-one, the player 26 is wagering on having a winning hand. In roulette, the player 26 is wagering that the ball will land on one of a number or color selected by the player. In craps, a player is wagering that the total value rolled on a pair of dice will be either the same, or different from a selected number. Thus, in craps the outcome of two primary wagers may be different for the same outcome of the gaming event. For example, a player who bets the pass line may win on a roll of the dice resulting in a total of 6, while another player that bets the no pass line would lose on the same roll. In slot machines, the primary player 40 wins if any of a number of predefined patterns (e.g., BAR-BAR-BAR) show up on the same line, or diagonal on the reels of the slot machine 20 (FIG. 1).

In step 240, the processing unit 100 determines whether the value of the counter N is less than the value of the counter I (i.e., whether all primary players have been processed). If the value of the counter N is less than the value of the counter I, the processing unit 100 passes control to step 236, where the counter N is incremented. If the value of the counter N is not less than the value of the counter I, the processing unit 100 passes control to step 242.

In step 242, the processing unit 100 initializes the counter N (i.e., N=0) in preparation for processing the secondary wagers. In step 244, the processing unit 100 increments the counter N (i.e., N=N+1). In step 246, the processing unit 100 determines the outcome of the secondary wager for the secondary player N.

Determining the outcome of the secondary wager typically includes comparing the determined outcome of the primary wager to the outcome wagered on by the secondary.player. Generally, a secondary wager for, or with, a primary player wins when the primary player wins, and loses when the primary player loses. A secondary wager against a primary player wins when the primary player loses, and loses when the primary player wins.

Thus, where the secondary player wagers for or with a primary player in a game of twenty-one, the secondary player wins the secondary wager if the primary player draws a winning hand, and loses the secondary wager if the primary player draws a losing hand. In contrast, where the secondary player wagers against a primary player in the game of twenty-one, the secondary player wins the secondary wager if the primary player draws a losing hand, but loses the secondary wager if the primary player draws a winning hand. In roulette, the outcome of a secondary wager for or with the primary player is successful if the primary player's wager was successful, and is a loss if the primary player's wager was unsuccessful. In contrast, the outcome of a secondary wager against the primary player in roulette is successful if the primary player's wager was unsuccessful, and is a unsuccessful if the primary player's wager was successful. Again, the game of craps presents an interesting example since the outcome of the primary wager can be different for two different primary wagers (e.g., pass, no pass) for the same gaming event (i.e., roll of dice) outcome.

In step 248, the processing unit 100 determines if there are additional secondary wagers for the secondary wagerer N. If there are additional secondary wagers for the secondary player N, the processing unit 100 passes control back to step 246. If there are no additional secondary wagers for the secondary player N, the processing unit passes control to step 250.

In step 250, the processing unit 100 determines if the value of the counter N is less than the value of the counter J (i.e., whether all secondary players have been processed). If the value of the counter N is less than the value of the counter J, the processing unit 100 passes control to step 244, where the counter N is incremented (N=N+1). If the value of the counter N is not less than the value of the counter J, the processing unit 100 passes control to step 252.

In step 252, the processing unit 100 initializes the counter N (i.e., N=0) in preparation for processing the tertiary wagers. In step 254, the processing unit 100 increments the counter N (i.e., N=N+1). In step 256, the processing unit 100 determines the outcome of the tertiary wager for the tertiary player N.

Determining the outcome of the tertiary wager typically includes comparing the determined outcome of the secondary wager to the outcome wagered on by the tertiary player. Generally, a tertiary wager for, or with, a secondary player when the secondary player wins, and loses when the secondary player loses. A tertiary wager against the secondary player wins when the secondary player loses, and loses when the secondary player wins. Where a secondary player wagered for, or with, a primary player, a tertiary wager for, or with, the secondary player amounts to a wager for, or with, the primary player. Where a secondary player wagered for, or with, a primary player, a tertiary wager against the secondary player amounts to a wager against the primary player. Where a secondary player wagered against a primary player, a tertiary wager for, or with, the secondary player amounts to a wager against the primary player. Finally, where a secondary player wagered against a primary player, a tertiary wager against the secondary player amounts to a wager for, or with, the primary player.

In step 258, the processing unit 100 determines if there are additional tertiary wagers for the tertiary player N. If there are additional tertiary wagers for the tertiary player N, the processing unit 100 passes control back to step 256. If there are no additional tertiary wagers for the tertiary player N, the processing unit 100 passes control to step 260.

In step 260, the processing unit 86 determines if the value of the counter N is less than the value of the counter K (i.e., whether all tertiary players have been processed). If the value of the counter N is less than the value of the counter K, the processing unit 100 passes control to step 254, where the counter N is incremented (i.e., N=N+1). If the value of the counter N is not less than the value of the counter K, the processing unit 100 passes control to step 262.

In step 262, the processing unit 100 initializes the counter N (i.e., N=0) in preparation for paying winnings to and/or collecting the wagers from the primary players. In step 264, the processing unit 100 increments the counter N (i.e., N=N+1). In step 266, the processing unit 100 determines whether the outcome of the primary wager of the primary player N is successful. If the outcome of the primary wager is successful, control passes to step 268 where the processing unit 100 determines the value of the payout. The value of the payout is a function of the amount of the wager and the odds for the particular wager. If the primary wager is not successful, the processing unit 100 passes control to step 270, where the primary wager is collected from the primary player N. The primary wager may be manually collected, for example by the dealer 30 (FIG. 1) or game operator 66 (FIG. 2) collecting the wagering pieces from a primary player (e.g., first player 26) who is present at the gaming position or other controlled location. The primary wager may alternatively be automatically collected by, for example, debiting an account belonging to the primary player for the wager amount. Automatic collection is particularly useful where the primary player (e.g., third player 40) is remote from the gaming position or other controlled location.

In step 272, the processing unit 100 determines whether there are additional primary wagers for the primary player N. If there are additional primary wagers for the primary player N, control passes back to step 266. If there are not additional primary wagers for primary player N, control passes to step 274, where the primary player N is paid. The primary player may be manually paid winnings, for example by the dealer 30 (FIG. 1) or game operator 66 (FIG. 2) transferring wagering pieces in the amount of the winnings to the primary player where the primary player (e.g., first player 26) is present at the gaming position or other controlled location. The primary player may alternatively be automatically paid, for example, by crediting an account belonging to the primary player with an amount equal to the amount of the winnings. Automatic payment is particularly useful where the primary player (e.g., third player 40) is not present at the gaming position or other controlled location.

In step 276, the processing unit 100 determines if the value of the counter N is less than the value of the counter I (i.e., whether all primary players have been processed). If the value of the counter N is less than the value of the counter I, the processing unit 100 passes control to step 264, where the counter N is incremented. If the value of the counter N is not less than the value of the counter I, the processing unit 100 passes control to step 278.

In step 278, the processing unit 86 initializes the counter N (i.e., N=0) in preparation for paying winnings to and/or collecting the wagers from the secondary players. In step 280, the processing unit 100 increments the counter N (i.e., N=N+1). In step 282, the processing unit 100 determines whether the outcome of the secondary wager of the secondary player N is successful. If the outcome of the secondary wager of the secondary player and is successful, the processing unit 100 passes control to step 284 where the value of the payout is determined. The value of the payout is a function of the amount of the wager and the odds for the particular wager. If the outcome of the secondary wager of the secondary player N is not successful, the processing unit 100 passes control to step 286 where the secondary wager is collected from the secondary player N. The secondary wager may be manually collected, for example by the dealer 30 (FIG. 1) or game operator 66 (FIG. 2) collecting the wagering pieces from the secondary player (e.g., second player 34) who is present at the gaming position or other controlled location. The secondary wager may alternatively be automatically collected by, for example, debiting an account belonging to the secondary player for the wager amount. Automatic collection is particularly useful where the secondary player (e.g., fourth player 44) is not present at the gaming position or other controlled location.

In step 288, the processing unit 100 determines whether there are additional secondary wagers for the secondary player N. If there are additional secondary wagers, the processing unit 100 passes control back to step 282. If there are no additional secondary wagers for the secondary player N, the processing unit 100 passes control to step 290 where the secondary player N is paid. The secondary player may be manually paid winnings, for example by the dealer 30 (FIG. 1) or game operator 66 (FIG. 2) transferring wagering pieces in the amount of the winnings to the secondary player (e.g., second player 34) who is present at the gaming location or other controlled location. The secondary player may alternatively be automatically paid, for example, by crediting an account belonging to the secondary player with an amount equal to the amount of the winnings. Automatic payment is particularly useful where the secondary player (e.g., fourth player 44) is not present at the gaming position or other controlled location.

In step 292, the processing unit 100 determines if the value of the counter N is less than the value of the counter J. If the value of the counter N is less than the value of the counter J, the processing unit 100 passes control back to step 280, where the counter N is incremented. If value of the counter N is not less than the value of the counter J, the processing unit 100 passes control to step 294.

In step 294, the processing unit 100 initializes the counter N to zero (i.e., N=0) in preparation for paying winnings to and/or collecting wagers from the tertiary players. In step 296, the processing unit 100 increments the counter N (i.e., N=N+1). In step 298, the processing unit 100 determines whether the outcome of the tertiary wager of the tertiary player N was successful. If the tertiary wager was successful, control passes to step 300 where the payout value is determined. The value of the payout is a function of the amount of the wager and the odds for the particular wager. If the outcome of the tertiary wager of the tertiary player N is not successful, control is passed to step 302 where the tertiary wager is collected from the tertiary player N. The tertiary wager may be manually collected, for example by the dealer 30 (FIG. 1) or game operator 66 (FIG. 2) collecting the wagering pieces from a tertiary player who is present at the gaming position or other controlled location. The tertiary wager may alternatively be automatically collected by, for example, debiting an account belonging to the tertiary player for the wager amount. Automatic collection is particularly useful where the tertiary player (e.g., fifth player 58) is remote from the gaming position or other controlled location.

In step 304, the processing unit 100 determines whether there are additional tertiary wagers for the tertiary player N. If there are additional tertiary wagers, control passes back to step 298. If there are no additional tertiary wagers for the tertiary player N, control passes to step 306 where the tertiary player N is paid. The tertiary player may be manually paid winnings, for example by the dealer 30 (FIG. 1) or game operator 66 (FIG. 2) transferring wagering pieces in the amount of the winnings to the tertiary player who is present at the gaming location or other controlled location. The tertiary player may alternatively be automatically paid, for example, by crediting an account belonging to the tertiary player with an amount equal to the amount of the winnings. Automatic payment is particularly useful where the tertiary player is not present at the gaming position or other controlled location.

In step 308, the processing unit 100 determines if the value of the counter N is less than the value of the counter K (i.e., have payment/collection for all tertiary players been processed). If the value of the counter N is less than the value of the counter K, the processing unit 100 passes control to step 296, where the counter N is incremented. If value of the counter N is not less than the value of the counter K, the processing unit 100 passes control to step 310, where the processing unit 100 updates the statistics for the primary players, secondary players and/or tertiary players. The method 200 terminates in step 312, although the method 200 may execute in a continuous loop, or in a multi-threaded fashion as suits the particular wagering system 10.

Although specific embodiments of and examples for the wagering system and method of the invention are described herein for illustrative purposes, various equivalent modifications can be made without departing from the spirit and scope of the invention, as will be recognized by those skilled in the relevant art. The teachings provided herein of the invention can be applied to other networked systems for wagering. For example, the teachings can employ networks other than the World Wide Web portion of the Internet. The teachings can employ other types of casino table games such as baccarat, Caribbean stud poker, Tai Gow poker, Hi/Low, Let-It-Ride™, and craps, as well as sporting and other events such as horse racing, auto racing, baseball, football, basketball, golf and tennis. While the illustrated embodiments show secondary and tertiary wagers, the invention is not limited to such, and one skilled in the art can easily adapt the teachings herein to further levels of wagering. Additionally, or alternatively, any player can wager on two or more levels, for example by placing both primary and secondary wagers or placing both secondary and tertiary wagers.

The various embodiments described above can be combined to provide further embodiments. All of the above U.S. patents, patent applications and publications referred to in this specification, including but not limited to U.S. patent application Ser. No. 10/062,636, filed Feb. 1, 2002; and U.S. Provisional Patent Application No. 60/300,253, filed Jun. 21, 2001, are incorporated herein by reference, in their entirety. Aspects of the invention can be modified, if necessary, to employ systems, circuits and concepts of the various patents, applications and publications to provide yet further embodiments of the invention.

These and other changes can be made to the invention in light of the above detailed description. In general, in the following claims, the terms used should not be construed to limit the invention to the specific embodiments disclosed in the specification and the claims, but should be construed to include all wagering systems that operate in accordance with the claims. Accordingly, the invention is not limited by the disclosure, but instead its scope is to be determined entirely by the following claims.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A method of facilitating gaming, the method comprising:

determining an outcome of a primary wager by a primary player based at least in part on an outcome of a gaming event; and determining an outcome of a secondary wager by a secondary player based at least in part on the determined outcome of the primary wager and a set of odds associated with the primary player indicative of a success rate of the primary player's previous play.

2. The method of claim 1, further comprising:

determining the set of odds associated with the primary player based at least in part on a number of outcomes of primary wagers previously placed by the primary player.

3. The method of claim 1, further comprising:

displaying the set of odds for at least the primary player to at least the secondary player.

4. The method of claim 1, further comprising:

paying out the secondary wager at the set of odds, if the secondary wager is successful.

5. The method of claim 1, further comprising:

paying out the secondary wager at the set of odds, where the primary wager is successful and the secondary wager is that the primary wager will be successful.

6. The method of claim 1, further comprising:

paying out the secondary wager at the set of odds, where the primary wager is unsuccessful and the secondary wager is that the primary wager will be unsuccessful.

7. The method of claim 1 wherein determining an outcome of a primary wager by a primary player based at least in part on an outcome of a gaming event comprises determining the outcome of a hand of blackjack played by the primary player.

8. The method of claim 1, further comprising:

determining an outcome of a tertiary wager by a tertiary player based at least in part on the determined outcome of the secondary wager and a set of odds associated with a secondary player.

9. A system to facilitate gaming, the system comprising:

means for communicating a set of odds associated with a primary player to at least a secondary player, the set of odds indicative previous successes of the primary player at a type of wagering game; and means for resolving a secondary wager placed by the secondary player based at least in part on an outcome of a primary wager by the primary player and the set of odds associated with the primary player.

10. The system of claim 9, further comprising:

means for determining the outcome of the primary wager by the primary player.

11. The system of claim 9 wherein the means for communicating a set of odds associated with a primary player to at least a secondary player comprises a display located proximate a location where the primary player places the primary wager.

12. The system of claim 9 wherein the means for communicating a set of odds associated with a primary player to at least a secondary player comprises a display located remotely from a location where the primary player places the primary wager.

13. The system of claim 9 wherein the means for communicating a set of odds associated with a primary player to at least a secondary player comprises a network.

14. The system of claim 9 wherein means for resolving a secondary wager placed by the secondary player based at least in part on an outcome of a primary wager by the primary player and the set of odds associated with the primary player comprises a host computing system processor and a memory storing instructions executable by the host computing system processor and communicatively coupled to the host computing system processor.

15. The system of claim 14 wherein the memory further stores the set of odds associated with the primary player.

* * * * *